US008398502B2

(12) United States Patent
Iwahashi et al.

(10) Patent No.: US 8,398,502 B2
(45) Date of Patent: Mar. 19, 2013

(54) HITTING POSITION DETECTING DEVICE, HITTING POSITION DETECTING METHOD, AND METHOD OF MANUFACTURING HITTING POSITION DETECTING DEVICE

(75) Inventors: Masayoshi Iwahashi, Osaka (JP); Akinari Ikka, Tokyo (JP); Pete Izumikawa, Tokyo (JP)

(73) Assignee: Mugen Inc. (JP)

( * ) Notice: Subject to any disclaimer, the term of this patent is extended or adjusted under 35 U.S.C. 154(b) by 390 days.

(21) Appl. No.: 12/744,877

(22) PCT Filed: Nov. 27, 2008

(86) PCT No.: PCT/JP2008/071546

§ 371 (c)(1),
(2), (4) Date: May 26, 2010

(87) PCT Pub. No.: WO2009/069698

PCT Pub. Date: Jun. 4, 2009

(65) Prior Publication Data

US 2010/0304877 A1 Dec. 2, 2010

(30) Foreign Application Priority Data

Nov. 27, 2007 (JP) ..... 2007-333133

(51) Int. Cl.
*A63B 69/36* (2006.01)

(52) U.S. Cl. ..... 473/223; 473/409

(58) Field of Classification Search ..... 473/219, 473/221, 222, 223, 226, 332, 333, 335, 350, 473/407, 409

See application file for complete search history.

(56) References Cited

U.S. PATENT DOCUMENTS 3,270,564 A 5/1964 Evans (Continued)

FOREIGN PATENT DOCUMENTS

CN 1829395 A 9/2006
DE 102006005048 A1 9/2006

(Continued)

OTHER PUBLICATIONS

International Search Report for PCT/JP2008/071546 mailed Mar. 10, 2009 with English translation.

*Primary Examiner* — Nini Legesse
(74) *Attorney, Agent, or Firm* — Cantor Colburn LLP

(57) ABSTRACT

A hitting position detecting device includes: a golf club which includes a shaft having a grip portion and a head portion having a face portion with a hitting surface and a rear surface and attached to the front end of the shaft; vibration wave sensors which is arranged on the side of the rear surface of the face portion and is fixed to the head portion so as to output electrical signals in accordance with a vibration wave generated upon hitting of the face portion; a calculation unit which detects arrival times in the vibration wave sensors of the vibration wave generated in the face portion upon hitting of a ball on the basis of the electrical signals, calculates a hitting position of the ball in the face portion on the basis of a difference in the plurality of arrival times, and then outputs the result as a hitting position signal; a display unit which displays the hitting position in the face portion on the basis of the hitting position signal output from the calculation unit; and a power source which supplies power to the vibration wave sensors, the calculation unit, and the display unit.

18 Claims, 9 Drawing Sheets

U.S. PATENT DOCUMENTS

| | | | | |
|---|---|---|---|---|
| 3,792,863 | A | 2/1974 | Evans | |
| 3,806,131 | A | 4/1974 | Evans | |
| 3,945,646 | A | 3/1976 | Hammond | |
| 4,088,324 | A | 5/1978 | Farmer | |
| 4,615,526 | A | 10/1986 | Yasuda et al. | |
| 4,659,090 | A | 4/1987 | Kustanovich | |
| 4,898,389 | A | 2/1990 | Plutt | |
| 4,991,850 | A * | 2/1991 | Wilhlem | 473/233 |
| 5,209,483 | A * | 5/1993 | Gedney et al. | 473/223 |
| 6,224,493 | B1 * | 5/2001 | Lee et al. | 473/223 |
| 6,923,729 | B2 * | 8/2005 | McGinty et al. | 473/222 |
| 8,172,684 | B2 * | 5/2012 | Adiraju et al. | 463/42 |
| 2006/0196272 | A1 * | 9/2006 | Sugiura et al. | 73/599 |
| 2007/0105639 | A1 | 5/2007 | Hasegawa | |
| 2009/0040761 | A1 * | 2/2009 | Huang et al. | 362/253 |
| 2009/0143159 | A1 * | 6/2009 | Murph et al. | 473/239 |
| 2010/0093463 | A1 * | 4/2010 | Davenport et al. | 473/342 |

FOREIGN PATENT DOCUMENTS

| | | | |
|---|---|---|---|
| FR | 2882825 | A1 | 9/2006 |
| JP | 56-31766 | A | 3/1981 |
| JP | 57-175371 | A | 10/1982 |
| JP | 57-175371 | | 10/1984 |
| JP | 59-183773 | A | 10/1984 |
| JP | 59-183773 | | 12/1984 |
| JP | 59-231462 | A | 12/1984 |
| JP | 62-192186 | A | 8/1987 |
| JP | 62-192186 | U | 12/1987 |
| JP | 63-206266 | A | 8/1988 |
| JP | 3-146079 | A | 6/1991 |
| JP | 3-146080 | A | 6/1991 |
| JP | 04-092273 | U | 8/1992 |
| JP | 4-92273 | U | 8/1992 |
| JP | 6-11027 | U | 2/1994 |
| JP | 06-11027 | Y | 3/1994 |
| JP | 10-267744 | A | 10/1998 |
| JP | 2000-84133 | A | 3/2000 |
| JP | 2004-81407 | A | 3/2004 |
| JP | 2004-358180 | A | 12/2004 |
| JP | 2005-6828 | A | 1/2005 |
| JP | 2006-242650 | A | 9/2006 |
| JP | 2007-130245 | A | 5/2007 |
| JP | 2007-296155 | A | 11/2007 |
| WO | 2007125655 | A1 | 8/2007 |

* cited by examiner

HITTING POSITION DETECTING DEVICE, HITTING POSITION DETECTING METHOD, AND METHOD OF MANUFACTURING HITTING POSITION DETECTING DEVICE

This is a U.S. national stage application of International Application No. PCT/JP2008/071546, filed on 27 Nov. 2008. Priority under 35 U.S.C. §119(a) and 35 U.S.C. §365(b) is claimed from Japanese Application No. JP2007-333133, filed 27 Nov. 2007, the disclosure of which is also incorporated herein by reference.

TECHNICAL FIELD

The present invention relates to a hitting position detecting device, and particularly to, a hitting position detecting device capable of simply obtaining a hitting position of a face portion of a golf club head with a high accuracy, a hitting position detecting method, and a method of manufacturing the hitting position detecting device.

Priority is claimed on Japanese Patent Application No. 2007-333133, filed on Nov. 27, 2007, the content of which is incorporated herein by reference.

BACKGROUND ART

For a long time, it has been a matter of great interest for learners and beginners to know a hitting stress, a hitting angle, or a ball hitting position (where a ball is hit by a face portion of a club head) regarding a practice golf club.

For this reason, without the need for reference documents, there has been a desire among golf players to know a measurement value of a certain type of a sensor or a transducer (an element for converting a physical characteristic into electrical signals, that is, converting one form of energy into another form of energy) attached to the golf club via a display (monitor) or the like.

When no specific embodiment is made clear, an abstract idea about a golf club attached with a sensor and a display unit on its own is not an invention, but something desired. It has been thought for a long time that the desire (problem) has not been practically solved or embodied despite many trials and suggestions since there is no information on the practical technology/method for the embodiment thereof and the accuracy thereof (recognition of existence of long-term unresolved problems).

There have been merely desires, but no complete disclosures containing contents including the practical accuracy based on "specific experiments" such as the arrangement position of sensors having a certain function, a timing of generating a certain calling signal, a calculation process, a display position, a certain display manner/shape, and a correct process through experiments (a long-term unresolved problem).

Meanwhile, although a method of imaging the golf club using a high-speed camera is a reliable method, the cost increases due to an increase in the size of the equipment. Since bright light is required due to the relationship between the sensitivity and the short shutter time, glare or the like influences the hitting action. In addition, since the camera needs to be installed before the ball to shoot the flying ball after hitting, the photographer is in great danger due to the ball flying before him/her, and the camera needs to be protected so that the camera is not broken. Such are the critical defects of this method (critical defects of solving means).

As far as the inventors know, as a specific method of detecting the hitting position of the ball, there is a method of attaching a pressure discoloring sheet to the face portion of the head portion, and determining the ball hitting position on the basis of the discolored sheet. This method has critical defects in that it is necessary to perform an operation of attaching the sheet to the face portion of the club and detaching the sheet after usage every time, the repeated consumption of the pressure sheets is bothersome, and the hitting feeling is different for each sheet (critical defects of solving means).

So far, Patent Documents 1, 2, and 3 disclose a proposal in which an accelerometer is attached to a golf club head, or a torsion meter or a strain meter is attached to a shaft, and a measurement value thereof is displayed on a remote monitor (a display unit: specifically, an oscilloscope).

In addition, there have been attempts to compare and display the repeated swing actions, but the display of the hitting position of the face portion has not been successful. Since many past Patent Documents are cited for reference in such Patent Documents, it is acknowledged that the above-described desire has existed for some time (recognition of existence of long-term unresolved problems).

In Patent Document 4, accelerometers are arranged in three directions perpendicular to each other inside a head, and a predetermined hitting data signal is compared with a current signal so as to estimate a hitting position on the face portion. However, the detail thereof is not shown, and the accuracy is not revealed. Also, regarding the ball, variations in strength, rotation, the type/maker of the ball, humidity, contamination, temperature, or the like should be considered. For this reason, it is not possible to sufficiently display the hitting position with a high accuracy only by using an "accelerometer" (a long-term unresolved problem).

In Patent Document 5, there is a proposal in which data of a graph obtained by a preliminary test result showing the relationship between a driving distance and attenuation of acceleration is displayed on a liquid crystal display (LCD) or a light emitting diode (LED) together with an impact value obtained through one accelerometer (transducer), but this is not the hitting position (recognition of long-term unresolved problems and a disclosure of a display method).

In Patent Document 6, there is disclosed a method of recognizing an existing sound source close to an unknown sound source in such a manner that a preliminarily obtained crest value or arrival time of the existing sound source is compared with a crest value or arrival time of the unknown sound source by using three or more sensors provided to search for a sound source of a structure such as a pressure container, and search for a similarity therebetween (pattern distance).

However, in this method, an object thereof is to search for a sound source in a large object such as a nuclear reactor container, and the existing sound source is compared with the unknown sound source by collecting data of points having a pitch of about 2 m. In the extremely small face portion of the golf club, the arrival time determined by an effective value, an average value, or amplitude of the sound of the existing sound source is substantially the same, and there is no difference therebetween. In addition, the same applies to the magnitude of the sound.

Accordingly, this method is not effective for specifying the hitting position of the golf club (unsuitableness of means). That is, in the method of searching for the three-dimensional position in the pressure container, it is necessary to acquire data of many hitting sound sources in advance. In addition, the accuracy is dependent on the number of sound sources acquired in advance. Furthermore, the detection position is basically obtained by discrete position detection.

In Patent Document 7, there is disclosed a method of measuring a head speed, a swing locus, a face angle, or the like in a manner where a magnetic sensor is provided below a ball setting position in a hitting practice room, and a magnetic signal generated by movement of metal at the time of a swing action is analyzed.

In this method, equipment needs to be prepared below a ball to be hit, the equipment is dependent on many types of largely different clubs, the data for each hitting position is not clear, and simplicity is degraded due to an excessive increase in size of the equipment involved. For this reason, it is not considered that the hitting position is successfully specified. The magnetic sensor is installed at a specific place on the outside of the club instead of the inside thereof, and is increased in scale (critical defects of solving means, and necessity of an underground installation).

In Patent Document 8, there is proposed a method of calculating an impact force and an impact position by concentrically disposing a selective conduction electrode layer and a pressure impedance layer. Although this method can be used in the measurement of sports such as golf or a pitcher's pitching practice, it should be noted that the impact generated upon hitting of the golf ball is of extremely high pressure. Then, regardless of the installation positions of the layers, the durability thereof is low when the layers are installed on the outside of the head, and a high accuracy cannot be obtained due to the impact on the face portion when the layers are installed on the inside of the head. Also, the layers may be broken. These were critical defects. More specifically, the correct hitting position could not be successfully specified (unresolved problems and critical defects of solving means).

In Patent Document 9, there is disclosed a concept in which a pressure sensor is attached to a golf club, and information on a ball is displayed at an appropriate place/portion using a microcomputer. Particularly, it is also mentioned that a hitting force value is measured and displayed by using a "pressure" sensor fixed to the lower portion of the shaft. This is similar to the contents of Patent Documents 1, 2, and 3. In this method, the description for the hitting position is brief and unclear (solving means is merely a desire and unclear).

In Patent Document 10, there is disclosed a method of detecting a hitting position in the forward/backward direction by using a transducer installed on the face portion of a putter in a detachable manner (or embedded in a wood club). In this method, there is a critical defect in that the transducer cannot withstand the repetition of a considerable impact value (estimated to be 1 ton/square centimeter) applied when the transducer comes directly into contact with the ball. In addition, in the specification of the position on the face portion only in the widthwise direction of the face portion (in Patent Document 10, it is thought that the position in the horizontal direction of the face portion can be specified due to the existence of a figure such as a piano keyboard, but the position in the vertical direction of the face portion cannot be specified), the vertical position is not clear, and this method could not successfully specify the hitting position (a long-term unresolved problem).

In Patent Document 11, there is disclosed a golf swing evaluation system in which a maximum hitting force and a hitting position are displayed on a display unit. However, the detailed contents for realizing the object are vague, and the claims are desirously expressed. As a specific example, the arrangement of piezoelectric sensors (pressure sensors) is disclosed, and means for analyzing the relationship between a voltage and a time is also disclosed.

A wristwatch-type display unit provided in the other end of the grip is also disclosed. Due to the viewpoints of durability and accuracy, and the desire without specific calculation for determining the position, it is not thought that the hitting position can be accurately and successfully displayed (a long-term unresolved problem).

In Patent Document 12, all desires are described as above. Then, specifically, a contact piece is provided in the face portion of the golf club so as to reach the inner surface, and a plurality of contact units (rubber pieces) is provided in the inner surface. Accordingly, when the golf club hits the ball, the contact piece is pressed so as to enter an electrical conduction state, thereby detecting the position and displaying the result on the display unit. However, since the calculation, that is, the calculation for a correct display is not clear, and a contact type is used, there are problems of limitations in durability, weight, difficult manufacture process, and many components and arrangement. Also, it is necessary to provide a plurality of contact pieces connecting from the outside to the inside of the face portion in the entire surface (critical defects in solving means and a plurality of holes in the face portion).

In Patent Document 13, there is disclosed a desire for estimating a driving distance and displaying a hitting position on display means of a liquid crystal type or a light emitting type provided in a shaft by using a plurality of detection means such as impact sensors for detecting the ball hitting position on the head, and a concept of the driving distance of a ball in accordance with the hitting position.

Since there is a problem in the installation toward a front surface of a metal plate of a head, it is supposed that there is no installation toward the front surface. In the installation toward the rear surface of the metal plate, since an impact pressure acts on the entire metal plate, it is not apparent how to detect and calculate the impact pressure, and thus this is merely a desire. In addition, since many various sensors having different properties are arranged, it is further deemed that this method is merely a desirous application (insufficient and desirous solving means).

In Patent Document 14, there is disclosed an analysis of sound by specifically utilizing the merit of a concentric arrangement of sensors (a problem to be solved by present invention cannot be solved by desirous solving means disposed in a concentric arrangement).

In addition, in Patent Documents 12 and 15 to 19, there is disclosed a method of recognizing the position on a sensor generating the largest signal or the vicinity thereof as a hitting point by disposing a group of sensors (in a matrix shape or a concentric shape or the like) in a face portion. Here, since many sensors are required, the weight of the golf club increases, and the attachment to the golf club is difficult. Also, since the sensors are installed at the hitting portion, the sensors are easily broken by impact, and the cost increases.

In addition, in Patent Document 21, a hitting position is obtained from a natural vibration frequency (frequency analysis) of a hitting sound. It is difficult to distinguish the natural vibration frequency, and it is not possible to obtain a high accuracy within several mm. Alternatively, it seems that this method may not be realized.

Patent Document 1: U.S. Pat. No. 3,270,564
Patent Document 2: U.S. Pat. No. 3,792,863
Patent Document 3: U.S. Pat. No. 3,806,131
Patent Document 4: U.S. Pat. No. 3,945,646
Patent Document 5: U.S. Pat. No. 4,088,324
Patent Document 6: Japanese Unexamined Patent Application, First Publication No. S59-231462
Patent Document 7: U.S. Pat. No. 4,615,526
Patent Document 8: U.S. Pat. No. 4,659,090
Patent Document 9: Japanese Unexamined Patent Application, First Publication No. S62-192186
Patent Document 10: U.S. Pat. No. 4,898,389

Patent Document 11: U.S. Pat. No. 4,991,850

Patent Document 12: Japanese Unexamined Utility Model Application, First Publication No. H04-92273

Patent Document 13: Japanese Unexamined Patent Application, First Publication No. 2000-84133

Patent Document 14: Japanese Unexamined Patent Application, First Publication No. 2004-81407

Patent Document 15: Japanese Unexamined Patent Application, First Publication No. H03-146079

Patent Document 16: Japanese Unexamined Patent Application, First Publication No. H03-146080

Patent Document 17: Japanese Unexamined Patent Application, First Publication No. S56-31766

Patent Document 18: Japanese Examined Utility Model Application, Second Publication No. H06-11027

Patent Document 19: Japanese Unexamined Patent Application, First Publication No. S57-175371

Patent Document 20: Japanese Unexamined Patent Application, First Publication No. S59-183773

Patent Document 21: Japanese Unexamined Patent Application, First Publication No. H10-267744

DISCLOSURE OF INVENTION

Problems to be Solved by the Invention

However, in the background art, there is only "a parade of desires" of a normal person who wants to perform "a display" by attaching an abstract noun "sensor" which can be easily thought by anybody. Furthermore, there is no sufficient description of specific means for substantially solving the problem of "the specific specification" which can be obtained by repeating "the hitting position". The practically complete technology is not disclosed, and the system is not simple (i.e., complex). Particularly, the technology cannot withstand the impact value generated at the time of the hitting action, and the determination is vague. Also, the golf club substantially becomes heavy due to an increase in the number of sensors.

Since there is no detailed description of the calculation method, the specific technology, or the embodiment for illustrating how to really calculate the position by processing a certain signal in a certain manner, it may not be considered that determination of the actual position is successfully performed (i.e., the invention is not completed). In addition, for this reason, the inventors could not find any completed inventions in the market at the current time.

Although only practical embodiment means/technologies should be allowed to be patents, in many cases, merely desirous expressions or abstract expressions are described in claims, and such extended concepts are determined to be publicly known, which often blocks technical advance. Particularly, in the method of specifying the hitting position on the face portion of the golf club with repeatability, desirous means have been mistakenly considered as the technologies for solving the problems.

In addition, since the above-described technology has not been introduced yet in the market, it is speculated that there have been several problems such as difficulties in embodying the technology, a poor accuracy in determining the hitting position, problem of immediate breakage, too much weight, a strange appearance, or difficulties in manufacturing the device.

Furthermore, in the piezoelectric element (transducer) such as PVDF (polyvinylidene fluoride), due to a reason that (1) a rigid metal plate is provided on the surface of the hitting portion of the head, (2) the outer peripheral portion is fixed (the analysis is difficult due to various boundary condition portions), and (3) the face portion is not flat, but has a slightly convex curved surface, it is difficult to clearly know the type of vibration, the vibration source, and the vibration form. In addition, it is completely different from the endlessly opened plate (there is a boundary condition). Furthermore, the electromotive force is small, the frangibility is high, and the deformation easily occurs. Also, it is completely unclear how to process the receiving value, and there is no verification of the position specification based on the experiment.

Furthermore, even in the usage of the piezoelectric element (transducer), examples of the piezoelectric element include a high polymer type and a ceramic type. However, it is not apparent where to fix an element having a certain degree of response speed to a certain portion of the head, and it is not apparent how to detect a certain portion of a certain vibration. In addition, it is completely unclear how to process the received value, and there is no verification of the position specification based on the experiment.

In the background art of obtaining the hitting position, generally, a method is widely used which disposes a plurality of contact pieces or pressure sensors in the entire face portion, and determines the position of the sensor reacting at the time of the hitting action, the position of the sensor generating the largest signal, or the vicinity thereof to be the hitting position. However, in such a method, the higher the accuracy is needed, the more the sensors are needed. As a result, there is the largest defect such that as the weight of the sensor increases, the sensor becomes vulnerable to impact, and the sensor cannot withstand an impact in practical usage.

An object of the present invention is to provide a detailed practical technology which can be used in the industrial field and does not have the above-described problems. In addition, particularly, it is thought that the largest problem of contradiction between light weight and accuracy or durability have not yet been solved. Accordingly, an object of the present invention is to provide means for improving the defect and simultaneously solving many problems having a trade-off relationship therebetween. These kinds of problems having a trade-off (antinomy) relationship are not revealed and solved in the known documents. For this reason, the present invention which can be introduced in the market (i.e., which can be embodied) needs to be provided.

Particularly, the main problems to be solved are as below, and another all objects will be apparent in the detailed description. That is, the insufficient parts in the proposal of the background art will be remarkably and practically improved.

The problems to be solved are as listed below.

(1) The hitting position detecting device needs to be used at any time (for example, at a practice range on a dark night), at any place (for example, even on a golf course), and at any time (for example, at rainfall) if there is provided a golf club capable of detecting a hitting position, instead of the case where the hitting position detecting device can be used to detect the hitting position only in a specific outdoor golf practice center provided with a specific equipment or indoors in a specific environment, (2) The number of sensors needs to be minimum, the sensor needs to be lightweight, and the sensor needs to have a low possibility that the sensor is broken by impact or the like, (3) The hitting position needs to be substantially correctly displayed so as to verify/check the hitting position, (4) The hitting position upon performing the hitting action needs to be correctly displayed (a simple swing not hitting the ball needs not to be erroneously displayed), (5) Actual means for determining the hitting position through certain means and calculation needs to be disclosed, (6) An electronic circuit for detecting the hitting position needs to be simple and small (it needs to be simple without attaching a large structure to the outside of a general club) (shape), (7) The total weight of the golf club needs to be light in a degree that the golf club can be practically used (weight), (8) The hitting position detecting device needs to withstand the repeated impact (durability), (9) The hitting position needs to be correctly displayed in the range of practical accuracy (precision),

(10) The consumption power needs to be small (electric power),

(11) The manufacture cost needs to be low (industrial feasibility, safety, repeatability, and economic efficiency),

(12) The processing needs to be simple (manufacturability),

(13) The hitting positioning detecting device needs not to give a burden to a user (easy care, easy viewing property, easy treating property, reset property, and readiness),

(14) The device needs to have a fairly good finishing without exhibiting a poor appearance (high-quality sensitive view),

(15) Special equipment needs not to be installed on the outside of the hitting position detecting device, that is, on the ground side,

(16) The result needs to be checked on site and easily viewed,

(17) The good or bad hitting position needs to be easily informed so as to know whether the user is skilled,

(18) The result needs to be restored even when missing the check of the result,

An object of the present invention is to solve all of the above problems with a balance. Particularly, an object of the present invention is to provide means for solving the industrial feasibility.

Means for Solving the Problems

The present invention provides a hitting position detecting device including: a golf club which includes a shaft having a grip portion and a head portion having a face portion with a hitting surface and a rear surface and attached to the front end of the shaft; vibration wave sensors which are arranged on the side of the rear surface of the face portion and is fixed to the head portion so as to output electrical signals in accordance with a vibration wave generated upon hitting of the face portion; a calculation unit which detects arrival times in the vibration wave sensors of the vibration wave generated in the face portion upon hitting of a ball on the basis of the electrical signals, calculates a hitting position of the ball in the face portion on the basis of a difference in the plurality of arrival times, and then outputs the result as a hitting position signal; a display unit which displays the hitting position in the face portion on the basis of the hitting position signal output from the calculation unit; and a power source which supplies power to the vibration wave sensors, the calculation unit, and the display unit.

The hitting position detecting device may include at least three vibration wave sensors; and the calculation unit may detect a difference in arrival time by setting two vibration wave sensors as a pair, and calculates the hitting position on the basis of the difference in arrival time obtained by at least two pairs of vibration wave sensors.

In the hitting position detecting device, the calculation unit may calculate $\Delta L1=a\times\Delta T1+b$ on the assumption that (1) each difference when a first pair of the vibration wave sensors detects the arrival of the vibration wave is denoted by $\Delta T1$, (2) each difference when a second pair of the vibration wave sensors detects the arrival of the vibration wave is denoted by $\Delta T2$, (3) vibration propagation constants stored in advance in the calculation unit are denoted by a, b, c, and d, and (4) a difference in distance from each of the first pair of vibration wave sensors to an imaginary hitting position is denoted by $\Delta L1$;

the calculation unit may calculate $\Delta L2=c\times\Delta T2+d$ on the assumption that (5) a difference in distance from each of the second pair of vibration wave sensors to the imaginary hitting position is denoted by $\Delta L2$;

the calculation unit may assume that (6) a difference in distance obtained in advance from each of the first pair of vibration wave sensors to each position P in all areas having desired hitting positions on the face portion is denoted by $\Delta Lp1$, and (7) a difference in distance obtained in advance from each of the second pair of vibration wave sensors to each position P in all areas having desired hitting positions on the face portion is denoted by $\Delta Lp2$;

(8) the calculation unit may obtain a position Ps by the following equation of $$Ps=\min\{(\Delta Lp1-\Delta L1)^2+(\Delta Lp2-\Delta L2)^2\}$$

on the assumption that an operator min{ } denotes a position P where the value { } becomes minimum; and the calculation unit may determine the position Ps to be the hitting position.

In the hitting position detecting device, the hitting surface of the face portion may be substantially formed in a trapezoid, and four vibration wave sensors may be respectively disposed at four corner points of the trapezoid. It is desirable that diagonal lines of the trapezoid intersect each other at the center portion of the face portion. In addition, the hitting position detecting device may include an operation error detection unit which detects an operation error of one of the four vibration wave sensors; and when the operation error detection unit detects an operation error of one of the vibration wave sensors, the calculation unit may set the other three vibration wave sensors as two pairs, and calculate the hitting position.

In the hitting position detecting device, the vibration wave sensors may be fixed to the rear surface of the face portion via at least one of a viscoelastic element and an elastic element.

In the hitting position detecting device, the vibration wave sensors may be fixed to the face portion so as to be perpendicular thereto, and be fixed by cylindrical elements each having a cavity therein.

The hitting position detecting device may include a measurement unit which measures at least one physical characteristic selected from a group including the position, the angle, the speed, and the acceleration of the shaft, and the speed and the acceleration of the head portion; and the calculation unit may be activated when at least one of the physical characteristics measured by the measurement unit reaches a predetermined value.

The hitting position detecting device may include a head speed measurement unit which detects a speed of the head portion; and the calculation unit may calculate the driving distance of a golf ball hit based on the head speed and the hitting position, and the display unit displays the driving distance thereon.

In the hitting position detecting device, the display unit may display the hitting position by using a predetermined symbol on a schematic figure of the head portion. The display unit may have a function of blinking the symbol.

In the hitting position detecting device, the calculation unit may calculate a higher score for the hitting position located closer to a great driving distance area or a sweet spot of the face portion; and the display unit may display the score thereon.

In the hitting position detecting device, the calculation unit may have a memory function of storing of the hitting position signal, and displays the past hitting position on the display unit in accordance with a request.

In the hitting position detecting device, the vibration wave sensors may automatically enter a measurement mode at the time of a swing action; and the display unit may automatically change a display screen at the time of the swing action, and include a reset button for returning an erased image to an original state.

In the hitting position detecting device, at least a part of the shaft and the head portion may be covered by an electric power generating element, and the electric power generating element may be electrically connected to the vibration wave sensors and the display unit so as to supply at least a part of the required electric power thereto.

The hitting position detecting device further includes: a transmitting unit which wirelessly transmits the electrical signals output from the vibration wave sensors; and a receiving unit which is provided separately from the golf club and receives the electrical signals, wherein the calculation unit and the display unit may be disposed separately from the golf club, and be connected to the receiving unit.

The present invention provides a hitting position detecting method including: hitting a ball by using a golf club which includes a shaft having a grip portion and a head portion having a face portion with a hitting surface and a rear surface and attached to the front end of the shaft; detecting each time at which a vibration wave generated in the face portion upon hitting of the ball arrives at vibration wave sensors which are arranged on the side of the rear surface of the face portion and are fixed to the head portion; calculating a hitting position of the ball in the face portion on the basis of each difference in arrival time of the vibration wave, and outputting the result as a hitting position signal; and displaying the hitting position in the face portion on the basis of the hitting position signal.

In the hitting position detecting method, the number of the vibration wave sensors is at least three, and the detection of the difference in arrival time is performed by at least two pairs of vibration wave sensors by setting two vibration wave sensors as a pair. The calculation of the hitting position is performed by the following steps:

calculating $\Delta L1=a\times\Delta T1+b$ on the assumption that (1) each difference when a first pair of the vibration wave sensors detects the arrival of the vibration wave is denoted by $\Delta T1$, (2) each difference when a second pair of the vibration wave sensors detects the arrival of the vibration wave is denoted by $\Delta T2$, (3) vibration propagation constants stored in advance in the calculation unit are denoted by a, b, c, and d, and (4) a difference in distance from each of the first pair of vibration wave sensors to an imaginary hitting position is denoted by $\Delta L1$;

calculating $\Delta L2=c\times\Delta T2+d$ on the assumption that (5) a difference in distance from each of the second pair of vibration wave sensors to the imaginary hitting position is denoted by $\Delta L2$;

assuming that (6) a difference in distance obtained in advance from each of the first pair of vibration wave sensors to each position P in all areas having desired hitting positions on the face portion is denoted by $\Delta Lp1$, and (7) a difference in distance obtained in advance from each of the second pair of vibration wave sensors to each position P in all areas having desired hitting positions on the face portion is denoted by $\Delta Lp2$, wherein (8) the calculation unit obtains a position Ps by the following equation of $$Ps=\min\{(\Delta Lp1-\Delta L1)^2+(\Delta Lp2-\Delta L2)^2\}$$

on the assumption that an operator min{ } denotes a position P where the value { } becomes minimum; and determining the position Ps to be the hitting position.

The present invention provides a method of manufacturing a hitting position detecting device, including: installing three or more sensors in a rear surface as a back portion of a face portion in the vicinity of the contoured portion or the substantially outermost periphery of a hitting surface called the face portion of a golf club so as to detect a vibration wave generated upon hitting of a golf ball; installing a calculation processing unit which calculates minute differences in arrival times of the vibration wave generated upon hitting of the ball by using two pairs of sensors in which two arbitrary sensors are set as a pair, and a combination of one of the two sensors and another sensor or a combination of two sensors other than the two sensors is set as another pair; installing a calculation function microcomputer unit which substantially calculates the hitting position on the basis of the minute differences in times obtained by the pairs of sensors; installing a display unit in a shaft of the golf club so as to simultaneously display a hitting position and an approximate outer shape of the face portion; and installing a power source for the microcomputer.

Effects of the Invention (1) The ball hitting position can be clearly determined. That is, the determination of the ball hitting position can be excellently conducted.

(2) The present invention is proved on the basis of a plurality of hitting results (the practical value of the numeral equations is acknowledged).

(3) The reliability is high due to the proof of the plurality of hitting results.

(4) The display can be successfully performed without using complex sensors.

(5) Particularly, the durability is remarkably and successfully improved.

(6) An advantage that a variation in data is small can be obtained.

(7) The weight can be reduced.

(8) Convenient means, which is operated without turning on or off switches every time, is conceived of When the advantage of the present invention is compared with the unclear method of solving the specification of the hitting position in the background art, the comparison result is as explained below. Compared with Patent Documents 15, 16, 17, 18, 19, and 12, in the method of the background art, the higher the accuracy is needed, the more the sensors are needed. However, in the present invention, the hitting position can be detected with a high accuracy by using a small number of sensors (the detection can be performed by a minimum of three sensors).

In addition, in the method of the background art, the hitting position can be detected only at several discrete points in accordance with the number of sensors. However, in the present invention, the continuous coordinate positions can be detected at any position on the face portion by using a minimum of three sensors.

In the method of the background art, since the sensor installation positions need to be disposed at the center portion of the face portion used to hit the ball or the entire portion thereof, a large impact is applied to the sensor upon hitting of the ball. However, in the present invention, since the sensors need not to be disposed (or it is preferable that the sensors not be disposed) at the center portion in the vicinity or periphery of the face portion (back portion), the hitting impact is small.

For this reason, the position detection points can be continuously detected on the face portion, and the detection accuracy thereof is high. The accuracy is 5 mm or less when hitting a golf ball at the position error of 2 mm or less by using an impact hammer similar to the ball. The sensor is lightweight, and can be easily attached to the head portion (the rear surface of the face portion). The cost of the sensor is low, and the sensor is hard break. Since the sensor is installed in the inner surface of the head portion, and is completely isolated from the outside, the sensor is not broken by wind and rain or mud. Even in other usage environments, the sensor can be robustly used (the reliability against the environment is high).

Furthermore, compared with Patent Document 21, the signal obtained by the sensor is a sound wave. However, in the present invention, basically, the propagation of the vibration (wave) propagated in the face portion as a metal plate is detected. In addition, the stationary wave is used in the frequency analysis, but in the present invention, the instant arrival time of the wave is detected. Accordingly, the position detection points can be continuously detected on the face portion, and the calculation process of the position detection with high detection accuracy is simple and fast.

Compared with the method of searching the three-dimensional position in the pressure container disclosed in Patent Document 6, basically, the object (purpose) is different from the two-dimensional hitting coordinate detection of the face portion of the golf club. In addition, the signal obtained by the sensor is a sound wave, but in the present invention, basically, the propagation of the vibration (wave) propagated in the face portion as a metal plate is detected.

In addition, in the known Patent Documents, the method of detecting the arrival time of the sound source is not disclosed. However, in the general method, the arrival time is detected by the magnitude of the amplitude or the average value or effective value of the sound detected by the sensor. Furthermore, in the present invention, the arrival time is detected on the basis of the instant value of the main vibration wave (the main vibration after the precedent vibration) of the vibration waveform detected by the sensor.

Furthermore, the method of searching for similarity between a plurality of existing sound sources and an unknown sound source by using a computer, that is, discrete (sound source) position recognition is different from the continuous position detection of the present invention in that the method and the result are different.

For this reason, the position detection point of the present invention can be continuously detected on the face portion with a high accuracy. Although the arrival time (propagation speed) of the sound wave is largely changed in accordance with temperature, since the vibration wave is used in the present invention, there is no influence of the ambient temperature. It is not necessary to collect a large amount of data in advance or to store the data in the computer.

There is a remarkable advantage in that the calculation process of the position detection is simple and fast. Here, a method may be adopted in which three or more sensors are provided as certain means, a leading vibration wave is detected from a sound wave instead of a mechanically propagated vibration wave, and a hitting position is detected on the basis of a difference in arrival time. Of course, this method is included in the scope of the present invention.

DESCRIPTION OF THE REFERENCE SYMBOLS

Figure 1:
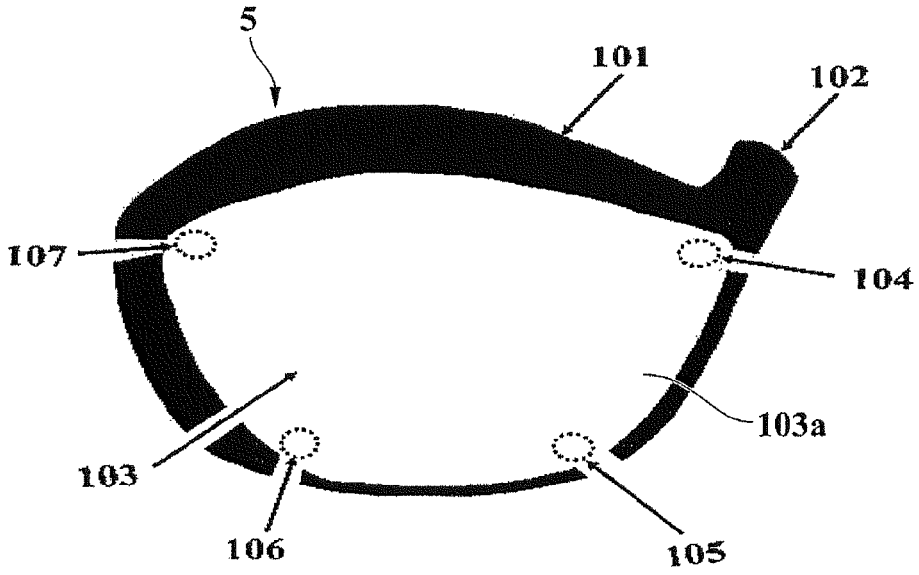
FIG. 1 is a diagram showing an arrangement of four microphone sensors in the outer periphery of a face portion corresponding to an embodiment of the present invention.

1, 50: hitting position detecting device
2: golf club
121: grip portion
120: shaft
5: head portion
103: face portion
103*a*: hitting surface
103*b*: rear surface
104, 105, 106, 107, 116: vibration wave sensor (microphone sensor)
9: calculation unit
54, 54A, 122: display unit
124: battery (power source)
12, 16: acceleration sensor
18: reset button
51: transmitting unit

52, 52A: receiving unit
53: antenna
60: head portion schematic image
61: hitting position display symbol
117: elastic element
119: sensor fixing cylindrical element

BEST MODE FOR CARRYING OUT THE INVENTION

Hereinafter, the present invention will be described in more detail with reference to the drawings.

Figure 13:
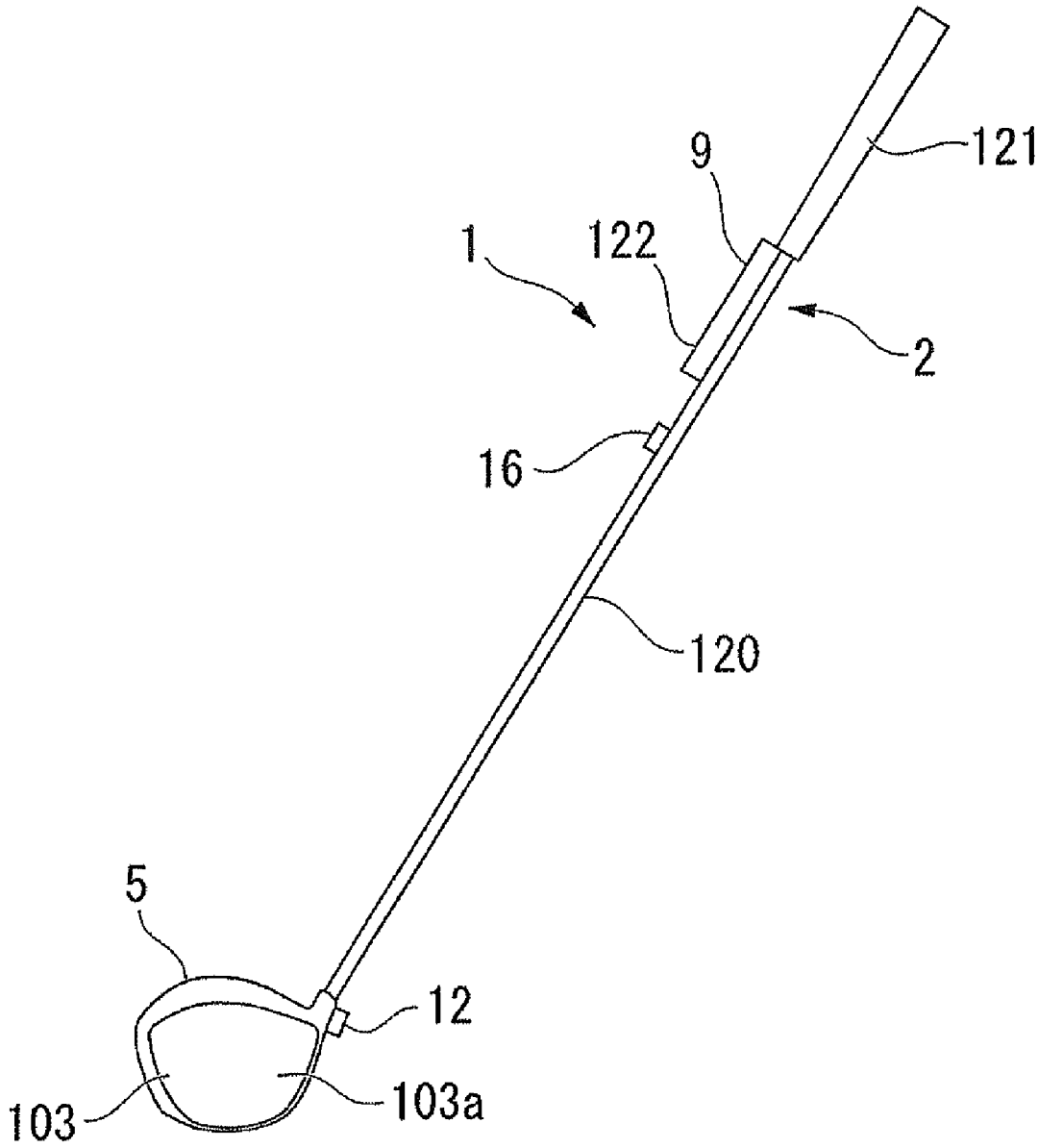
FIG. 13 is a schematic diagram showing an embodiment of a hitting position detecting device according to the present invention.

FIG. 13 is a schematic diagram showing an embodiment of a hitting position detecting device of the present invention. A hitting position detecting device 1 according to an embodiment of the present invention includes a golf club 2 which includes a shaft 120 having a grip portion 121, and a head portion 5 having a face portion 103 with a hitting surface 103*a* and a rear surface 103*b* (refer to FIG. 3) and attached to the front end of the shaft 120; a microphone sensors (vibration wave sensors) 104, 105, 106, and 107 (refer to FIG. 1) which are arranged on the side of the rear surface 103*b* of the face portion 103 and is fixed to the head portion 5 so as to output electrical signals 110 and 113 (refer to FIG. 2) in accordance with vibration waves generated upon hitting of the face portion 103; a calculation unit 9 which detects arrival times t1 and t2 (refer to FIG. 2) in the vibration wave sensors 104, 105, 106, and 107 of the vibration waves generated in the face portion 103 upon hitting of a ball on the basis of the electrical signals 110 and 113, calculates a hitting position of the ball in the face portion 103 on the basis of a difference (t2−t1) in the plurality of arrival times, and then outputs the result as a hitting position signal; a display unit 122 which displays the hitting position in the face portion 103 on the basis of the hitting position signal output from the calculation unit 9; and a battery 124 (power source) (refer to FIG. 4) which supplies power to the plurality of microphone sensors 104, 105, 106, and 107, the calculation unit 9, and the display unit 122. The hitting position detecting device 1 further includes an acceleration sensor 12 which detects acceleration/speed of the head portion 5, and an acceleration sensor 16 which detects the acceleration/speed of the shaft 120.

The hitting position detecting device 1 includes three or more sensors (A, B, C, D, etc.) (example: reference numerals 104, 105, 106, and 107 in FIG. 1) which detect vibration waves generated upon hitting of a golf ball in the substantial outer periphery (e.g., the vicinity of the contoured portion of the face portion (reference numeral 103 in FIG. 1)) of the face hitting surface 103*a* of the head portion 5 of the golf club 2 or the rear surface (back surface) 103*b*, i.e., the rear surface in the vicinity of the face contoured portion. Among these sensors, an arbitrary two of them (A and B) are used as a pair (AB), and a combination (AC or BC) of one (A or B) of the two and one (C) of another sensor, or a combination of two sensors (C and D) other than the two (A and B) is used as another pair of sensors (CD). Accordingly, minute differences in the arrival times of the vibration wave are detected by these two pairs of sensors (two pairs of AB, AC, BC, and CD). The hitting position detecting device includes the calculation unit 9 having a calculation function of calculating the substantial hitting position on the basis of the minute differences in times, and the display unit 122 provided in the club shaft 120 and simultaneously displaying the substantial outer shape of the face portion 103 and the hitting position calculation result. In addition, the reference numerals denoted by A, B, C, and D are provided for easy understanding.

A second feature is the following method. That is, the method of manufacturing the hitting position detecting device is characterized by the following combination. Three or more sensors are provided in the substantial outermost periphery of the hitting surface called the face of the golf club or the rear surface of the face as the back surface in the vicinity of the contoured portion so as to detect vibration waves generated upon hitting of a golf ball. Among these sensors, arbitrary two of them are used as a pair, and a combination of one of the two and another sensor, or a combination of two sensors other than the two is used as another pair of sensors. Among these two pairs of sensors, each pair of sensors constitutes a calculation processing unit for calculating minute differences in the arrival times of vibration waves generated upon the hitting of a ball. Furthermore, a calculation function microcomputer unit is provided so as to calculate the substantial hitting position on the basis of minute differences obtained by the pairs of sensors. A display unit is provided in the shaft so as to simultaneously display the hitting position and the approximate outer shape of the face, and a computer power source is provided.

Here, as the sensor for detecting the waves, a capacitive microphone sensor is particularly suitable. Regarding the capacitive microphone sensor, electric capacity varies upon receiving instant waves, whereby electric signals vary (reference numerals 110 and 113 in FIG. 2). These signals are compared with threshold values of predetermined voltage levels (reference numerals 109 and 112 in FIG. 2), where the time points exceeding the threshold values are denoted by (reference symbols t1 and t2 in FIG. 2). It is found that the time between t1 and t2 can be detected by a difference in the arrival time of vibration waves.

In addition, a comparatively small wave (reference numeral 114 in FIG. 2) is detected before main vibration waves in accordance with the positional relationship between the hitting position and the sensor position, but the arrival time is detected by the instant size of the main vibration. In addition, examples of the microphones include a dynamic type, a ribbon type, a carbon type, and a crystal type. Furthermore, as the position detecting sensor, a sensor based on other operation principles may be used if the instant value of the vibration wave can be detected.

For example, a capacitive sensor such as a microphone, a proximity sensor having high speed and high accuracy, a piezoelectric sensor having a high speed response, and other sensors of a magnetic type, an optical type, and a contact type may be used, which are included in the scope of the present invention. In the combination with an elastic element to be described later in detail, general piezoelectric elements can be used.

As a piezoelectric element mainly used together with an elastic material, a crystal, zinc oxide, Rochelle salt (sodium potassium tartrate), lead zirconate titanate (generally called PZT), lithium niobate, lithium tantalate, lithium tetraborate, langasite, aluminum nitride, turmaline (tourmaline), and polyvinylidene fluoride (PVDF) may be exemplified.

In the past, it was generally thought that the sensor needed to be disposed at an easily movable region upon hitting, that is, a large impact receiving position. In other words, it was though that the position should desirably be the center of the face or the center portion. In addition, it was thought that the sensor should never be disposed in the vicinity of the outer shell.

This is because the periphery of the face is firmly fixed to the rigid outer shell (reference numeral 101 in FIG. 1) of the head so as not to move. It is thought that a portion without a support may be easily movable even by a minute pressure, and may easily transmit pressure to a piezoelectric element, and so on. This unexpected method is a peculiar technology for overcoming the unexpected characteristics and difficulties of the present invention using an unexpected technique.

In addition, regarding the method of detecting the arrival time of the vibration wave from the hitting point by installing the vibration detecting sensor such as a capacitive microphone in the vicinity of the outer shell of the face portion, a sound wave expert gave the advice that it is not possible to detect the propagation time from the side (outer shell) of the face portion to the hitting position on the grounds that vibration of a rigid metal plate such as titanium is instantly changed to a planar wave (for example, a state as in a planar speaker). Based on the advice, the inventors almost abandoned the development once.

In addition, the idea that a cushion such as a rubber to be described later is interposed so as to detect the vibration also elicited a similar surprise. This is because an elastic body obviously weakens the vibration. In addition, it is a peculiar point of the present invention that the microphone sensor is selected under the circumstances in which the piezoelectric element is selected as a general technical means.

However, after trial and error, the inventor made a surprising discovery. When a sensor capable of detecting the instant waveform of vibration in the vicinity of the outer shell of the face portion is provided to detect arrival of waves on the basis of a predetermined threshold value, and position detection calculation is performed on the basis of a new concept using a difference in time between a pair of sensors, a satisfactory result can be obtained on the condition that the sensor is disposed in the vicinity of the outer periphery instead of the vicinity of the center of the face portion within a range that the sensor can be installed without three-dimensional interference of the outer shell (reference numeral 101 in FIG. 1) of the head portion 5. In addition, herein, the calculating function of calculating the substantial hitting position on the basis of a difference in time between the pair of sensors may be called a timer unit (timer).

The present invention skillfully takes advantage of the new knowledge. More amazingly, it is found that a damper as an elastic element prevents the breakage of the sensor (which may be called a vibration receiving sensor) used herein to receive vibration, and thus obtains an advantage of improving durability.

The above findings will be described later. Of course, in the case where a part of a ball comes into contact with the outer shell 101 of the head portion 5 (the case of being extremely off target), unfortunately an accurate detection is not performed. However, despite such a case, the main effectiveness of the present invention is not impaired.

The inventors first performed a test using an impact hammer, then performed a test using an imitation product (a shoulder massager using a golf ball), and finally performed a test using a hitting machine (hitting robot). According to this, due to the nature of the machine, a repeated performance of within 1 to 2 mm was observed in the hitting position. In addition, a commercially available hitting verification sheet was attached to investigate a discolored position, and this was repeated several times. As a result, it was found that the repetition occurs at the same position.

In addition, meanwhile, since there are also oval balls among balls made by a machine, it is not described that every ball flies in the same direction at the same hitting position. This is because the test was performed by using the hitting robots prepared in the laboratory in the net. Of course, a human field test was performed by researchers including people such as a retired professional golfer.

A third feature is as below. That is, the present invention provides a hitting position detecting golf club in which the arrival of the vibration wave is detected by a calculation processing unit detecting the arrival time of the "leading vibration wave" described in the specification, and a microcomputer unit as the following first and second calculation function units is provided so as to execute the calculation function of calculating the substantial hitting position on the basis of minute differences in times obtained by each of the pairs of sensors.

(The above-described) first calculation function unit:

(1) A difference upon detecting a leading vibration wave by a pair of sensors is denoted by ΔT1, (2) A difference upon detecting a leading vibration wave by another pair of sensors is denoted by ΔT2, (3) Values stored in advance in a computer are denoted by a, b, c, and d, (4) A difference in distance from a pair of sensors to a hitting position is denoted by ΔL1, and (5) A difference in distance from another pair of sensors to a hitting position is denoted by ΔL2, $$\Delta L1=a\times\Delta T1+b\ \Delta L2=c\times\Delta T2+d$$

The second calculation function unit:

(6) A difference in distance from a pair of sensors to each position P in all areas having desirable hitting positions on the face portion is denoted by ΔLp1, (7) A difference in distance from another pair of sensors to each position P in all areas having desirable hitting positions on the face portion is denoted by ΔLp2, and (8) A hitting position Ps is determined on the basis of a result of the following equation (where the first and second calculation function units constitute a calculation function unit).

$$Ps=\min\{(\Delta Lp1-\Delta L1)^2+(\Delta Lp2-\Delta L2)^2\}$$

Here, the operator min{ } indicates the position P where the value of { } is minimum.

In the present invention, as a verification result obtained after hitting the same position by using a hitting robot, a commercially available impact hammer, and a hammer imitation product having a ball attached to a head thereof, the above-described calculation method was fine regardless of the kind of test. In the case where the ball hits the outside of the sensor in numerous tests, unfortunately measurement could not be performed. Apart from this exception, amazingly, the correct result was obtained as the hitting position. That is, the case of the impossible measurement corresponds to the case of an extremely off target hitting position.

Herein, it is sufficiently verified that the calculation of the above-described equation, that is, the method called a source calculation method (the source is a central point of a vibration source upon hitting of a ball) is correct. The method is performed as the above-described calculation equation. Although some unexpected errors are found as an exception as mentioned above, the effectiveness of the present invention is not impaired because the sensor units are disposed in the vicinity of the outermost periphery, and the positions at which such measurement errors are found are the outermost periphery which may be excluded from a detection region.

Since the measurement needs to be completed in a short time while withstanding such a load, the detection portion needs to handle both requirements. In many sensors introduced in the market, whether or not the sensors can be operated while meeting the response speed and the instant pressure is often completely unconfirmed, and, without testing and verification, such types of inventions can be said to be meaningless.

Here, the calculation process of determining the hitting position of the microcomputer is performed by the following method. That is, on the assumption that one pair of sensors is denoted by W1 and the other pair of sensors is denoted by W2, a difference ΔLp1 in the distance from two sensors W1 to an arbitrary position (Xp, Yp) on the two-dimensional orthogonal coordinates (X and Y axes are supposed) set in the face portion and a difference ΔLp2 from two sensors W2 thereto are calculated in advance in all areas having desirable hitting positions on the face portion, and the calculated values are stored in a memory of a computer.

Regarding the vibration wave generated upon hitting of a ball by the face portion, when a difference in time of a leading vibration wave detected by two sensors W1 is ΔT1, and a difference in time of a leading vibration wave detected by two sensors W2 is ΔT2, the hitting position (Xg, Yg) is obtained by the following calculation.

$$\Delta L1=a\times\Delta T1+b \quad \text{equation (1)}$$

$$\Delta L2=c\times\Delta T2+d \quad \text{equation (2)}$$

$$(Xg, Yg)=\min\{\Delta Lp1-\Delta L1)^2+(\Delta Lp2-\Delta L2)^2\} \quad \text{equation (3)}$$

However, in the above-described equations (1) and (2), a, b, c, and d are original values (vibration propagation constants) of the club which are determined by the sensor position or the material and shape of the head. In addition, in the equation (3), ΔLp1 and ΔLp2 are preliminarily obtained and stored in the memory of the computer, and respectively correspond to a difference in distance from two sensors W1 to an arbitrary position (Xp, Yp) and a difference in the distance from two sensors W2 thereto.

The calculation operator min{equation} indicates the coordinates (Xp, Yp) where the value of { } becomes the minimum. The computer calculates the value of { } for each point (Xp, Yp), and determines that the hitting position (Xg, Yg) is the point where the value becomes the minimum.

In the above-described calculation, a method may be used which mathematically obtains the two-dimensional hitting position on the basis of the detected values ΔL1 and ΔL2 and the sensor position. In this case, a plural or negative solution may be obtained mathematically. However, when the sensor arrangement positions are appropriately selected in the face portion to be described later, and the condition of the solution is limited within the area of the two-dimensional face portion, one solution is obtained.

However, in the mathematical method, since it takes a great deal of calculation time in order to obtain a solution of a numerical equation including a complex function (even when an approximate equation is used), this method is not practical.

Instead of conducting the complex mathematical calculation using the microcomputer, the inventors used a method of promptly obtaining a coordinate which is the closest to the condition of differences ΔL1 and ΔL2 of two pairs of sensors, that is, in which the mathematical distance of the detected values ΔL1 and ΔL2 and differences ΔLp1 and ΔLp2 in the distance from each pair of sensors to an arbitrary point (Xp, Yp) becomes the minimum by the use of the repetitive calculation of the computer.

The mathematical solution of the present invention uses "the concept of a difference in the arrival time of the vibration wave". As long as "the concept of a difference in the arrival time" is included in the present invention, other mathematical solutions are also included in the scope of the present invention. The coordinate system may be an orthogonal coordinate system or a triangular coordinate system.

As a fourth feature of the present invention, in the case where the inner rear surface of the face portion of the golf club is substantially formed as a reverse trapezoid, a hitting position detecting golf club, which has a high positioning accuracy and in which two pairs of sensors (four sensors) are provided in the vicinity of four corner points of the reverse trapezoid of the inner rear surface of the face portion so as to detect the vibration waves, is preferable.

Even when the number of sensors is three, the hitting position detection of the present invention can be performed. The reason why four sensors are provided on purpose is because the case of three sensors has an area where detection errors in the arrival time of the vibration waves cause comparatively large errors in the position detection calculation result in accordance with the hitting position. Of course, when the calculation is performed by using a computer with a high accuracy, the degradation of accuracy can be prevented even in the case of three sensors, but this calculation is not practical.

In order to detect the hitting position with a high accuracy within a practical time while the sensors are mounted to a golf club and consume low power, a method is particularly effective in which as described above four sensors are installed in the vicinity of four corner points of the golf club face portion (inner rear surface) substantially formed in a reverse trapezoid, and the position is detected by two pairs of sensors each including two sensors located at an opposite angle (e.g., two pairs of 104-106 and 105-107 in FIG. 1 which substantially intersect each other at the center of the face portion).

In addition, as a fifth feature of the present invention, there is provided a golf club which has high positioning accuracy and in which two pairs of sensors (four sensors) are provided in the vicinity of four corner points of a reverse trapezoid of the inner rear surface of the face portion so as to detect the vibration waves, and as the arrangement positions of two pairs of sensors, four sensors are disposed so that two lines connecting two pairs of sensors intersect each other while substantially forming a right angle in the center portion (a sweet spot or the vicinity thereof) of the face portion.

Even in this case, when the calculation is performed for some time by using a computer with a high accuracy, the hitting position can be detected even when two lines connecting two pairs of sensors intersect each other with a small angle. However, when two pairs of sensors are disposed so that the two lines intersect each other with a large angle at an intersection position located at the center portion (a sweet spot or the vicinity thereof) of the face portion, the accuracy of the position detection becomes fairly improved in the case of conducting the calculation using the same computer.

Particularly, a golf learner generally tries to hit the vicinity of the center portion of the face portion, and is curious about the hitting position with higher accuracy in the vicinity of the center portion rather than the peripheral portion. Accordingly, such an arrangement is an effective method of improving the accuracy with particular regard to the center portion.

In addition, as a sixth feature of the present invention, there is provided a malfunction sensor complementary hitting position detecting golf club in which two pairs of sensors (four sensors) are provided in the vicinity of four corner points of a reverse trapezoid of the inner rear surface of the face portion so as to detect the vibration waves, a function unit is provided so as to detect an erroneous operation of one of the four sensors, a calculation unit is provided so as to automatically select two pairs of sensors from the other three sensors, and a calculation processing unit using them is provided.

In the present invention, the position detection accuracy is improved by providing the sensors for detecting four vibration waves. More amazingly, if there is a desire to use the sensors for a longer period while allowing for slight degradation of accuracy, in the case where any one of four sensors is broken, the computer automatically distinguishes the broken sensor, the position detection calculation using the other three sensors is selected, and the sensors can be used for a longer period by using the three sensors.

In addition, as a seventh feature of the present invention, there is provided a hitting position detecting golf club in which a viscoelastic element or/and an elastic element are interposed and fixed between the sensor and the inner surface as the rear surface of the face portion. In the present invention, the manufacturing method of the hitting position detecting club in which the sensor for detecting the vibration waves is fixed by interposing an elastic element (reference numeral 117 in FIG. 3) between the sensor and the face portion (inner rear surface) is good.

The sensor generally has a structure which directly reacts against a pressure signal of a wave so that the sensitivity or response thereof does not degrade. As a result, when a general sensor is installed in the face portion of the golf club, the sensor is broken by an extremely strong impact. Accordingly, even in a method of fixing the sensor in a portion other than the face portion (including the periphery of the outer shell of the face portion) via a support body, the structure thereof is complex, and the strength of the support body itself against impact is difficult to maintain.

Figure 3:
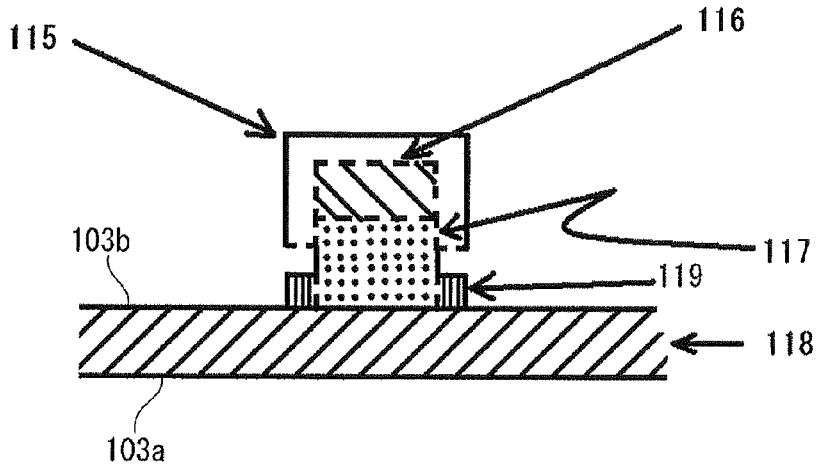
FIG. 3 is a diagram showing a state where the microphone sensor is attached to the rear surface of the face portion.

In the present invention, in order to withstand strong hitting impact, the sensor (reference numeral 116 in FIG. 3) is fixed to the face portion (rear side) (reference numeral 118 in FIG. 3) via an elastic body (reference numeral 117 in FIG. 3). Here, as a particular description, it is generally thought that the propagation time is prolonged by a damper when interposing the damper, and the arrival time of the vibration wave of the face portion is not able to be detected or is extremely difficult to detect due to this influence. The "damper" mentioned herein is a unit or a material for absorbing vibration.

However, the inventors found that the arrival time of the vibration wave can be correctly detected even when the elastic body (damper) is interposed between the sensor and the face portion in the case of using a capacitive microphone sensor or a sensor capable of detecting the vibration wave and having a performance in which response characteristics for a mechanical vibration wave or a vibration wave propagated in air are substantially equal thereto.

In addition, the elastic body may be provided in the sensor itself in advance, or the sensor and the face portion may be directly fixed to each other by an adhesive, which is allowed to have elasticity in a cured state. Herein, the elastic body indicates a wide variety of materials having characteristics substantially equal to those of the elastic body, and examples thereof also include a viscoelastic material or a material substantially equal thereto.

The viscoelastic material may be referred to as a rubber-like material. In the embodiments, polyurethane and synthetic rubber are mentioned as examples. Examples of elastomers representatively include vulcanized natural rubber, various synthetic rubbers, polyurethane, and the like. Materials containing a small amount of an elastomer component are also included.

The viscoelasticity is one of the dynamic characteristics of solids and fluids, and is a phenomenon in which deformation is generated by an external force in the manner of elasticity unrelated to time and of viscous fluidity influenced by time. The viscoelasticity is apparently generated in high polymer materials. In addition, the elastic body is the name of an object when mentioning deformation within the limit of elasticity, and objects having a particularly large elastic limit such as rubber, urethane rubber, and synthetic rubber may correspond thereto.

Accordingly, amazing findings were unexpectedly obtained, in which impact resistance of the sensor was improved, and a detection type having a high accuracy and no errors was realized. From the viewpoint of developing a "practical" hitting position detecting golf club as described above, this advantage is considered as an extremely remarkable advantage.

In addition, as an eighth feature of the present invention, there is provided a hitting position detecting golf club in which the material fixing the sensor is formed in a cylindrical shape having a cavity, and is provided so as to be substantially vertically fixed to the face portion. In the present invention, a hitting position detecting golf club is preferable in which the cylindrical element having a cavity therein and used to fix the sensor detecting the vibration wave is substantially vertically fixed to the face portion.

In the present invention, it is necessary to accurately and reliably fix the sensor to a predetermined position. That is, in the case where the fixing position (i.e., the coordinate on the face portion) of the sensor is calculated by a computer, when the fixing position deviates from the coordinate value used in the calculation, errors are generated in the detection result. Accordingly, in the case of manufacturing the club head, it is necessary to accurately fix the sensor to a predetermined position. In addition, it is necessary to strongly fix the sensor so that it can withstand a strong impact.

Generally, in the manufacture of the club head, the head is manufactured in such a manner that a plurality of metal plates forming the outer shape of the head are welded and fixed to each other. In the case of manufacturing the club head of the present invention, since the sensor or the sensor cable is weak against heat, it is necessary to fix the sensor after the welding operation of the club head. In this case, a hole is opened in a part of the outer shape of the head subjected to the welding operation, and an operation of fixing the sensor to the rear surface of the face portion is performed therethrough. However, in order to fix the sensor to the accurate position, it is necessary to attach the sensor by providing a machine such as a robot or by providing a particular tool.

In addition, since the sensor is extremely weak against heat, an adhesive having strong adhering force is used for the fixing operation. Regarding the strong adhesive, it takes at least from several hours to one day for the adhesive to be completely fixed after the application thereof. It is necessary to pay attention so that a deviation of the sensor position does not occur during the long curing time.

In order to solve such a problem, the inventors found a method in which a fixing cylindrical element (reference numeral 119 in FIG. 3) having a cavity therein is welded and fixed to a sensor fixing target position in advance in the manufacture of the club head, and an elastic element integrated with the sensor is adhered and fixed thereto. The method is effectively used to improve the accuracy (i.e., the detection accuracy of the hitting position) of the attachment position, ensure the fixing strength of the sensor, and facilitate the manufacture thereof.

Particularly, since the cylindrical element having a cavity therein is provided, it is possible to improve the fixing strength by largely ensuring the attachment surface of the elastic element integrated with the sensor, and to prevent the adhesive from flowing.

In addition, as a ninth feature of the present invention, there is provided a hitting position detecting golf club in which a position measurement unit, an angle measurement unit for a swinging shaft, a speed measurement unit, or an acceleration measurement unit for a shaft or a head is provided, and a signal processing unit is provided so as to substantially activate a calculation unit for calculating a difference in arrival time of a vibration wave of a pair of sensors when the position or the angle of a swinging shaft or the speed or the acceleration of a shaft or a head becomes a predetermined value.

The object of the ninth feature is to realize a decrease in electrical power and a decrease in weight. The swing speed measurement unit or the acceleration sensor measurement unit is provided, and this type of sensor is commercially available. The sensor exhibits a remarkable advantage when combined with the product of the present invention.

Generally, it is necessary to prepare a switch for activating a timer or setting an initial state of an electric circuit upon starting the measurement, but in this case, a switchless structure is configured without the switch. With such a structure, excellent convenience is achieved. Furthermore, there is an advantage of reducing the amount of electrical power needed.

Any sensor may be used if the sensor can detect a time point immediately before the hitting action upon arriving at the portion. For example, a torsion sensor (a strain sensor, and strain becomes large due to the acceleration immediately before the hitting action) attached to the shaft, a club head position detecting sensor (the time point immediately before the hitting action is determined as the time point when coming close to the ground surface), or the like may be used.

In addition, as a tenth feature of the present invention, there is provided a hitting position detecting golf club in which a sensor unit is provided so as to measure a head speed, and a display unit is provided so as to display the driving distance of a golf ball which is calculated from the head speed and the hitting position.

When a ball is hit at a certain speed, the driving distance thereof is changed in accordance with the hitting position, and the relationship between the position and the driving distance is disclosed already in several documents. However, in the existing hitting position detecting method, the detection accuracy is low (in addition, the method is not used in practice due to its heavy weight and fragility). Even when the driving distance is displayed, the driving distance is substantially divided into several ranges, and one of the ranges is selected to display the driving distance.

According to the detection method of the present invention, since the position detection can be performed with accuracy of 2 mm under a good condition and 5 mm or less even under a bad condition throughout substantially the entire face portion, it is possible to continuously and correctly estimate and display the driving distance.

Of course, in the present invention, since the opening degree or the swing direction of the face portion at the time of the hitting action is not detected, the driving distance detection/display reflecting the influence on the driving distance is not performed. However, if it is possible to obtain information on the driving distance in the case where a user's hitting action is performed in the condition of the correct opening degree of the face portion and the correct swing direction, the information is used as extremely effective information for improvement of a golf swing technique, particularly in the case of a practice in a narrow space such as a home yard or a narrow golf practice room where a ball is hit into a net.

In addition, as an eleventh feature of the present invention, there may be further provided a golf club capable of detecting a hitting position by including a display unit which displays the center portion of the hitting ball on the background of the outer shape of the face portion of the golf club of the approximate face figure by turning on one of the symbols of a dot "•", a plus "+", a cross "X", and circles "○", "●", and "◎" (concentric double circle).

Furthermore, the above symbols may be combined. Since a display unit (reference numeral 122 in FIG. 4), which is small enough not to cause any interference, is provided in the vicinity of a grip (reference numeral 120 in FIG. 4) of the shaft, it has been found that the display unit needs to be very easily recognizable, and this is extremely important.

In the test before arriving at the present invention, a method was first conceived of which detects the hitting position in such a manner that lengthwise and widthwise numerals/symbols/signs are provided in the separately made drawing of the face portion to show the hitting position, the numerals/symbols/signs are displayed on a small monitor when the hitting position is determined, and the signs are compared with the signs in the separate figure of the face portion provided handy.

This method has a critical defect in that a comparison needs to be performed every time. However, since the monitor (LED, liquid crystal, plasma, and organic display) can be formed at a very small size, there is an advantage in that the manufacturing cost is low, and the device is sufficiently compact.

In the state where the numerals such as Arabic numerals 1, 2, 3, 4, 5, an so on are attached to the face portion in the widthwise direction, and the symbols A, B, C, D, and E are attached thereto in the lengthwise direction, when "1A" is displayed, it signifies the upper forward direction. Accordingly, it is found that this golfer tends to hit at "1A". However, this method is not pleasant or convenient because a person has to carry a separate table sheet.

In order to display the hitting position, the hitting position is displayed on the outer shape of the face portion. For this reason, it is very important to display the outer shape of the face portion on the monitor. When the outer shape of the face portion is substantially displayed as a reverse trapezoid, it is very easy to detect the hitting position.

As a twelfth feature of the present invention, there may be further provided a golf club capable of detecting a hitting position in such a manner that a score is made to increase as the hitting position substantially becomes close to the sweet spot of the face portion or an area of a great driving distance, and the score is displayed on the display unit.

When a certain equation is defined by the combination of detection information on the hitting position or the hitting position, the head speed, the face opening degree, and so on, and the result is displayed as a score, the hitting technique can be simplified as the form of the "score". Accordingly, this is an effective method of determining the current level of the user's technique or the improvement degree after a certain period of practice.

In addition, as a thirteenth feature of the present invention, there may be further provided a golf club capable of detecting a hitting position by including a display unit which has a function of blinking a display/symbol.

In the hitting position display of the present invention, a golf club is also included which has a display unit having a function of "blinking" the display/symbol. It is found that even a small display unit can be remarkably and easily noticeable due to the blinking thereof. Furthermore, when the color is red (when a color display is used), the determination performance is improved exponentially regardless of the blinking or the non-blinking thereof.

In addition, as a fourteenth feature of the present invention, there may be further provided a golf club capable of detecting a hitting position which has a function unit storing one or both of plural hitting positions and which scores and displays the stored hitting positions or the scores by the operation of a switch or the like.

During a golf practice or the like, naturally, the improvement of the technique is attempted by swinging a golf club many times. The present invention is characterized in that the swing result can be checked on site. However, there is a case where the user wants to see the hitting position in the past or the hitting position or the score at a certain time, and to check the current practice result. For this reason, it is found that a configuration is useful in which a function unit is provided to store the hitting positions or the scores, the swing result of a certain time is stored therein, and the result is displayed again by a certain operation.

In addition, as a fifteenth feature of the present invention, there may be further provided a golf club capable of detecting a hitting position by including a sensor unit and a display unit which automatically enter a measurement mode at the time of swinging the golf club and completely change a display screen, and a reset button which returns a disappeared image to an original state.

It is desirable that an acceleration sensor or the like detect a motion upon swinging the golf club, a past display image be erased, and a next measurement be made ready. With such a configuration, the measurement mode can be automatically enabled without pushing a switch or the like every time. However, occasionally, there is a need to display the past record. Through the test using the golf club, it has come to the inventor's knowledge that a user sometimes carelessly swings the golf club. The switch and the memory are provided in order to make it possible to recover the past state by pressing the reset button at that time.

In addition, since the acceleration sensor or the impact sensor is mentioned in the above known examples, the inventor is afraid of confusion between the manner of use of such a sensor in the main portion of the present invention and the manner of use in the known examples. Accordingly, it should be noted that these usages must be correctly distinguished.

In addition, as a sixteenth feature of the present invention, there may be further provided a hitting position detecting golf club equipped with an electric power generating unit in which at least the shaft of the club or the head is covered with electric power generating materials, and a connection portion is provided to electrically connect the sensor, a power source for the sensor, or a power source for the display unit.

There are people who directly send a golf club bag from one country club to the other country club. For this reason, many of them may lose batteries. In order to avoid this situation, it is very important to make batteries unnecessary or to prolong the lifetime of the batteries. In recent years, the performance of light receiving power generation films has rapidly advanced. Accordingly, when a solar battery (films in many cases) is wound or attached on the surface of the club shaft, the battery may not be needed. Since golf is played in a bright place, it is easy to ensure a light source.

In addition, as a seventeenth feature of the present invention, there may be further provided a hitting position detecting golf club by including a set of an operation unit which is operated by receiving power from a transmitting antenna provided in a club by the approach of a wristwatch-type display unit or a display unit attached with a separately installed receiving antenna, a transmitting unit which receives information, and a receiving unit which performs a calculation process.

There is a case in which a person's habits or data need to be statistically processed or analyzed. At that time, it is necessary to transfer data to other devices, such as a cellular phone, a mobile PC, or a wristwatch-type microcomputer. Since it is not desirable to store a large amount of data in the club in view of an increase in weight, it is desirable to transfer the data to peripheral devices. The data may be transferred in a wireless manner (RFID).

In the present invention, it is important from a psychological viewpoint to give notice of the measurement mode by blinking an LED, and such a mechanism may be employed in the present invention. When the hitting action is performed at a good position, a sound such as, for example, "nice shot" may be generated or music may be played. When the hitting action is performed at a bad position, a sound or comment for encouragement may be generated. By using a cheap device of the present invention, commercials may be inserted in the announcement. This sales promotion may be utilized for the distribution of this type of device. However, when the device becomes heavy, it may lose its original purpose.

In the second feature, a hitting position detecting golf club is included in which the calculation function microcomputer unit, substantially calculating the hitting position on the basis of minute differences in times obtained by each of the pairs of sensors, has a function of performing the next calculation process.

That is, when the computer detects the hitting action, the computer promptly detects the arrival time of the leading vibration wave by using two sensors of one pair of sensors W1, and obtains a difference ΔT1 in time by calculation. At the same time, the computer detects the arrival time of the leading vibration wave by using two sensors of the other pair of sensors W2, and obtains a difference ΔT2 in time by calculation. By using the values a, b, c, and d stored in advance in the computer, the ΔT1 and ΔT2 are converted into differences ΔL1 and ΔL2 in distance from each pair of sensors by the following equation.

$$\Delta L1=a\times\Delta T1+b\ \Delta L2=c\times\Delta T2+d$$

In addition, the computer preliminarily stores differences ΔLp1 and ΔLp2 in distance from two pairs of sensors to each position in all areas having desirable hitting positions on the face portion, and obtains the value of the following equation by the calculation based on ΔL1 and ΔL2 obtained by the calculation of the detected time difference signals, and ΔLp1 and ΔLp2 stored for each position.

$$(\Delta Lp1-\Delta L1)^2+(\Delta Lp2-\Delta L2)^2$$

The position in which the value obtained by the calculation result becomes the minimum is determined to be the hitting position.

FIG. 1 (and FIG. 2) shows an example of the face portion and the rear surface to be attached with the sensors of the present invention, where the reference numeral 103 denotes the face portion of the head, and the reference numerals 104, 105, 106, and 107 denote the sensors of the rear surface (inside). In addition, this is a drawing showing the arrangement of the sensors on the outer periphery of the face portion according to the embodiments of the present invention.

That is, the sensors are arranged in the vicinity of the outer periphery of the face portion, or four corner points of the face portion formed in a reverse trapezoid so that the hitting impact is not directly propagated thereto. In addition, the sensors are arranged so that the intersection point of two lines connecting two pairs of sensors having one pair of sensors 104 and 106 and another pair of sensors 105 and 107 is located in the vicinity of the center portion of the face portion, and the two lines intersect each other while substantially forming a right angle.

Figure 2:
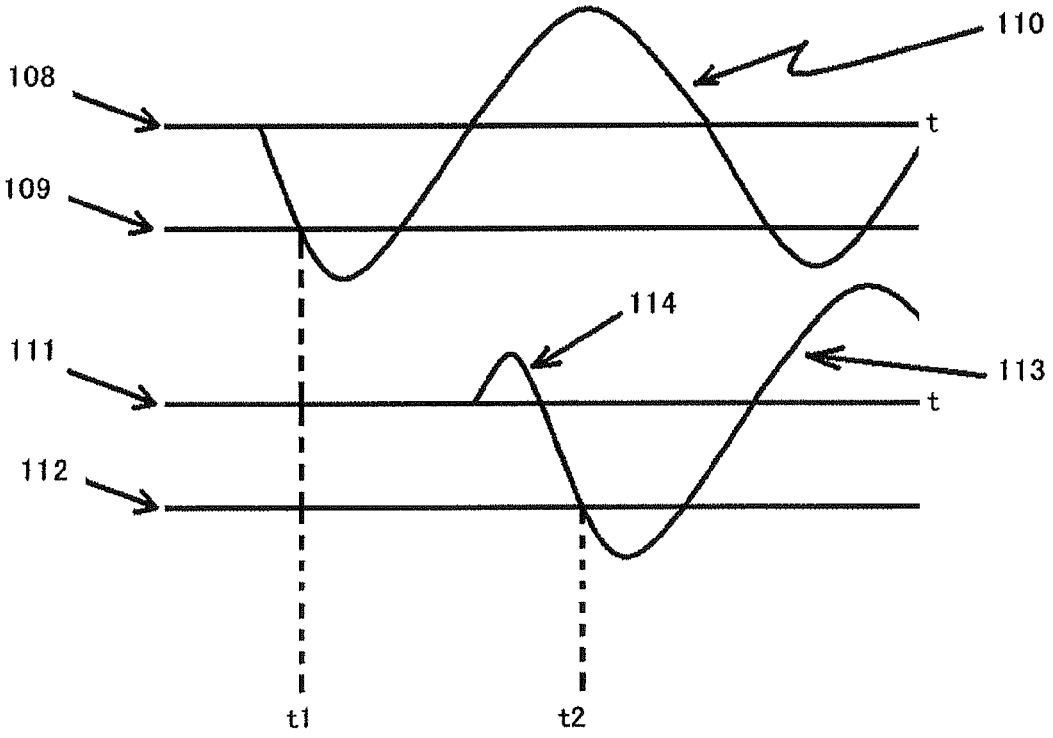
FIG. 2 is a diagram showing a method of detecting a difference in arrival time and arrival times of a hitting vibration wave and a leading vibration wave detected by two microphone sensors.

FIG. 2 shows electromagnetic waveforms detected by two sensors and having a difference in time therebetween. This is a drawing showing a method of detecting the arrival time of the hitting vibration wave to the sensor and a difference in the arrival time between a pair of sensors. The reference numeral 110 denotes the leading vibration waveform first received by the sensor, the reference numeral 113 denotes an example of the leading vibration waveform subsequently received by the sensor, and the reference numerals 109 and 112 respectively denote determination reference voltages (threshold values) used for determining the arrival time of the leading wave of the sensor signal.

That is, the pair of sensors compares the received signal waveforms with the predetermined determination reference voltage (threshold value), and detects time points (t1 and t2 of the drawing) when the waveforms first coincide with the determination reference voltage. Accordingly, it is possible to detect a difference in the arrival time by calculating the minute difference t2−t1 at that time.

FIG. 3 is a diagram showing an example of a state where the sensor is attached to the rear surface of the face portion. That is, the sensor 116 is fixed to the face portion via the elastic element (natural rubber in the embodiments to be described later) 117 instead of being directly fixed to the face portion. The reference numeral 115 denotes a casing for fixing the sensor and the elastic element.

When a structure of the sensor being buried in rubber is adopted, the casing 115 is not essentially required. The reference numeral 119 is a cylindrical element which is preliminarily fixed to the optimal sensor position of the rear surface of the face portion by welding or adhering. By using the cylindrical element, it is possible to easily, accurately, and strongly fix the sensor to the face portion.

Figure 4:
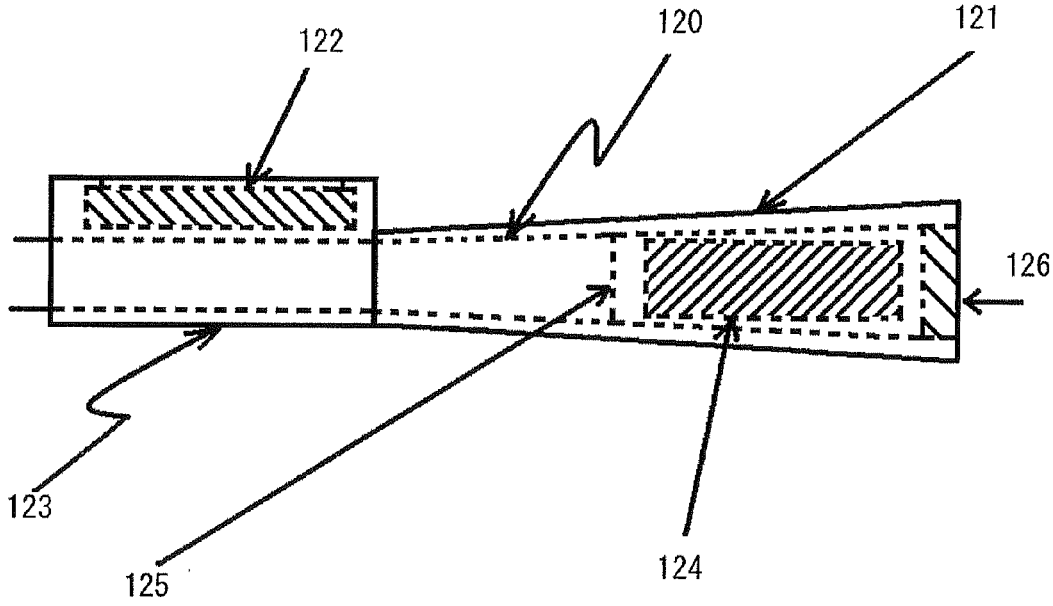
FIG. 4 is a schematic diagram showing a state where a display unit and a battery are attached to a shaft.

FIG. 4 is a schematic diagram showing a state where the display unit and the battery are attached to the shaft. That is, the battery 124 may be embedded in the shaft 120 (even when a shaft having a particular shape is not used). When the display unit 122 is provided in the front end of the grip 121, the attachment of the display unit does not influence the swing action or give any inconvenience. Also, the screen can be easily viewed.

Figure 5:
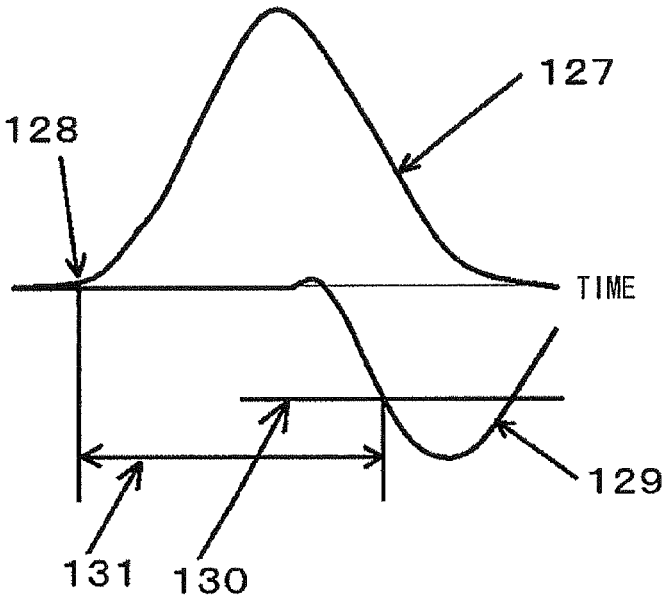
FIG. 5 is a diagram showing a hitting output signal of an impact hammer and a leading waveform received by a microphone sensor.

FIG. 5 is a diagram showing a leading waveform received by the microphone sensor and a hitting output signal of an impact hammer. That is, it is possible to detect an arrival time 131 in such a manner that the propagation time of the vibration wave generated by the hitting action is determined on the basis of a start time 128 of the hitting output signal 127 of the impact hammer and an arrival determination reference voltage 130 of a waveform 129 received by the microphone sensor.

Figure 6:
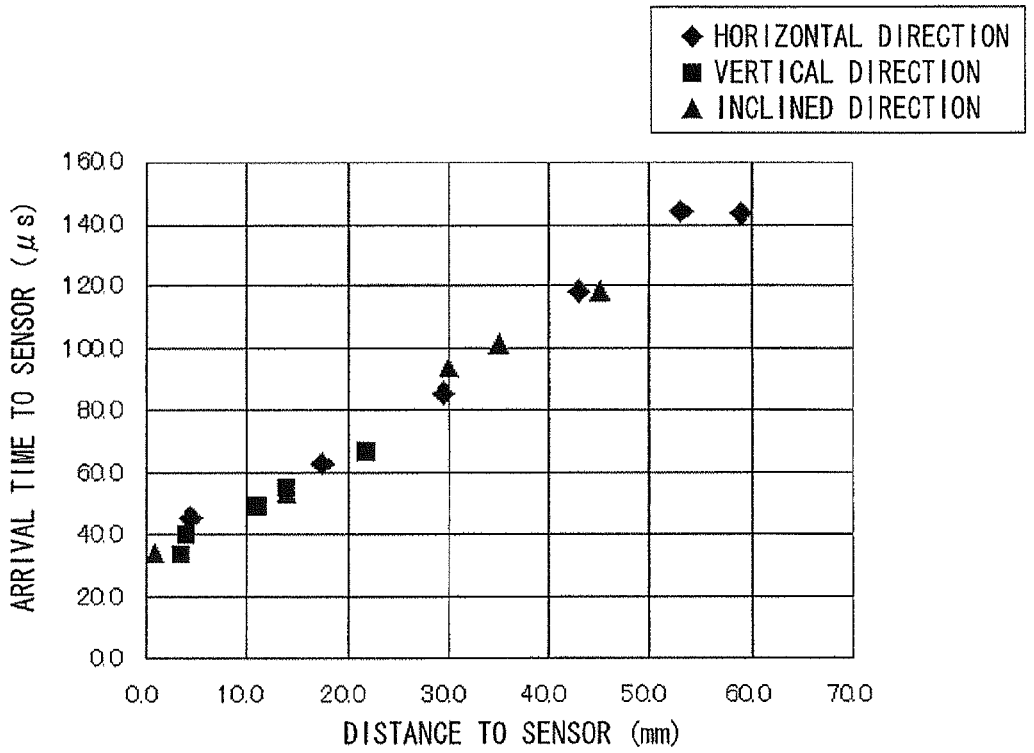
FIG. 6 is a diagram showing actual measurement values of the arrival time of a leading vibration wave of a microphone sensor and a distance from a hitting point to the microphone sensor upon the hitting of a face portion by an impact hammer.

FIG. 6 is a diagram showing actual measurement values of the arrival time of the leading vibration wave of the sensor and a distance from the hitting point to the sensor upon hitting of the face portion with the impact hammer.

That is, the vibration wave is propagated in the face portion substantially at the same speed, and the speed is not dependent on the propagation direction. As a result, it is found that the arrival time of the vibration wave is proportional to the distance from the hitting point to the sensor.

Figure 7:
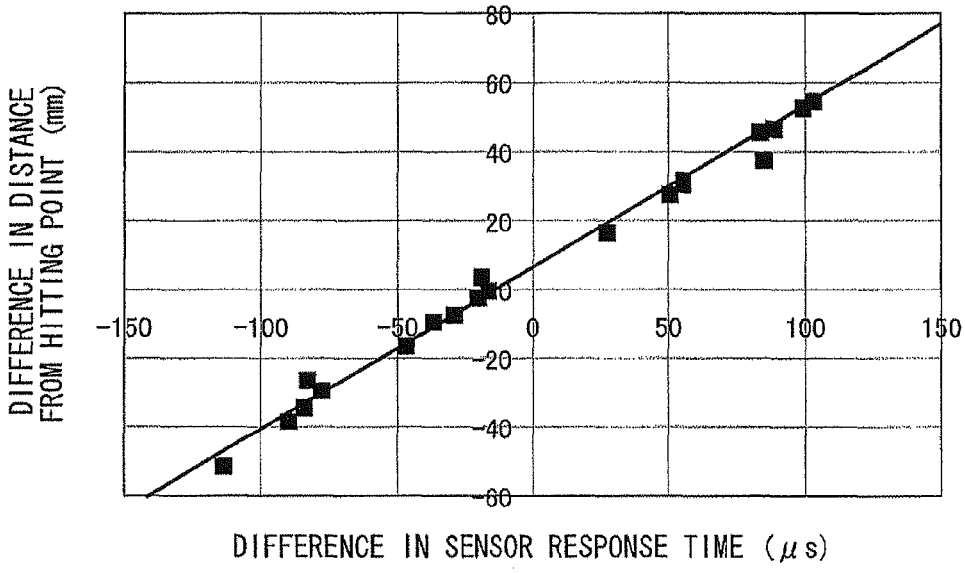
FIG. 7 is a diagram showing actual measurement values of a difference in the response time of a pair of sensors and a difference in the distance from a hitting position.
Figure 8:
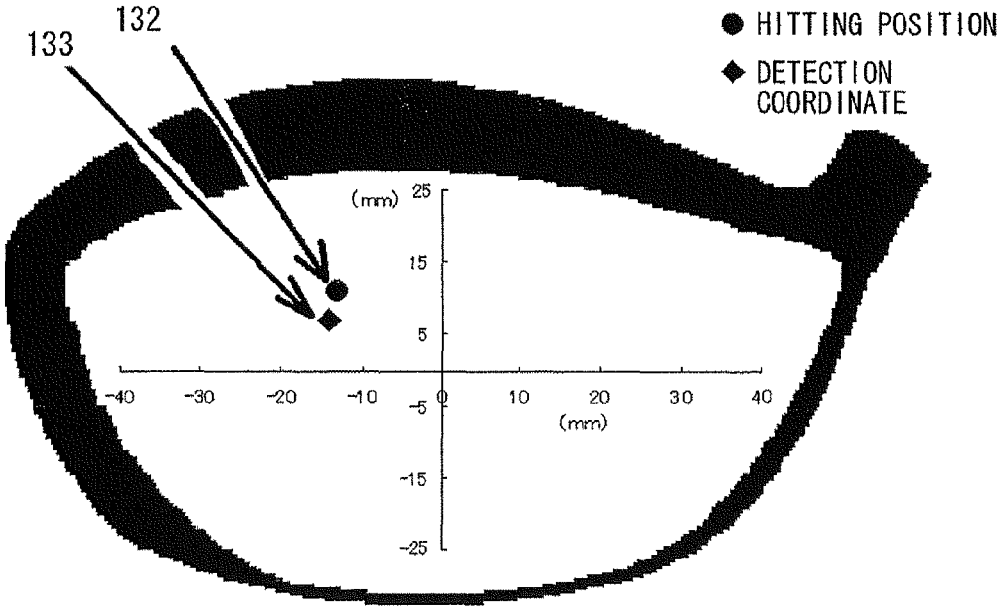
FIG. 8 is a diagram showing actual measurement values of a detected hitting position and of an actual hitting position.
Figure 9:
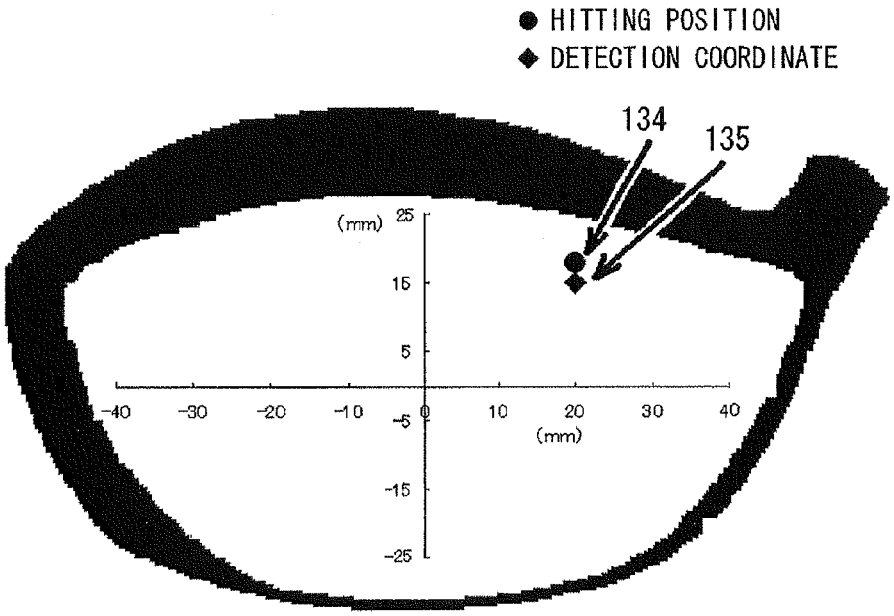
FIG. 9 is a diagram showing actual measurement values of a detected hitting position and of an actual hitting position.
Figure 10:
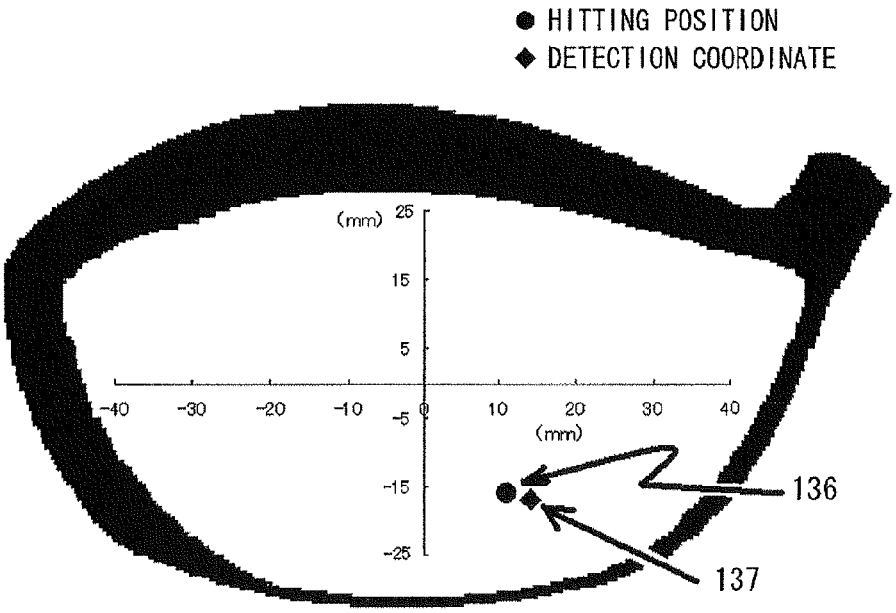
FIG. 10 is a diagram showing actual measurement values of a detected hitting position and of an actual hitting position.
Figure 11:
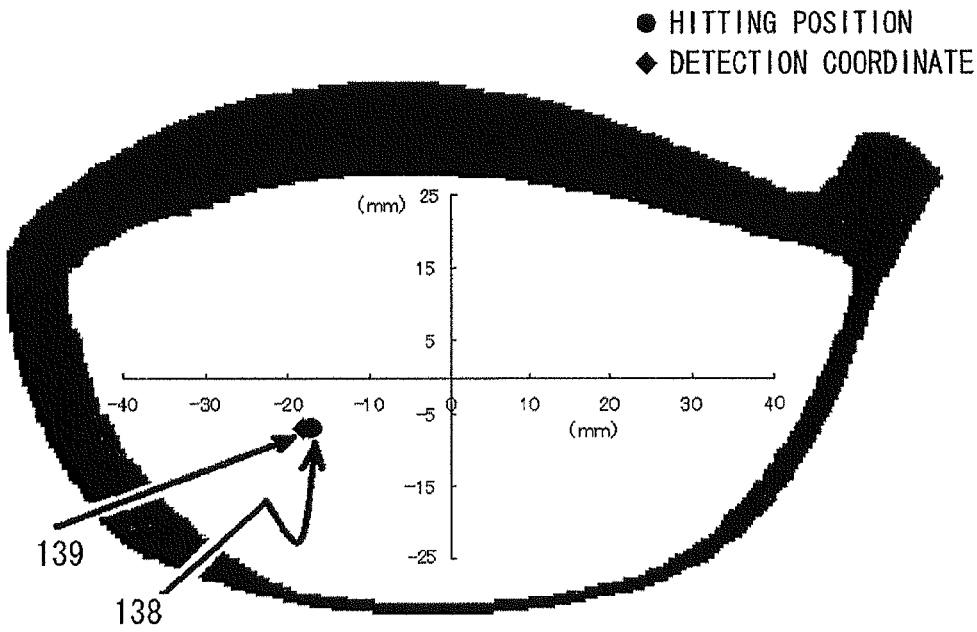
FIG. 11 is a diagram showing actual measurement values of a detected hitting position and of an actual hitting position.
Figure 12:
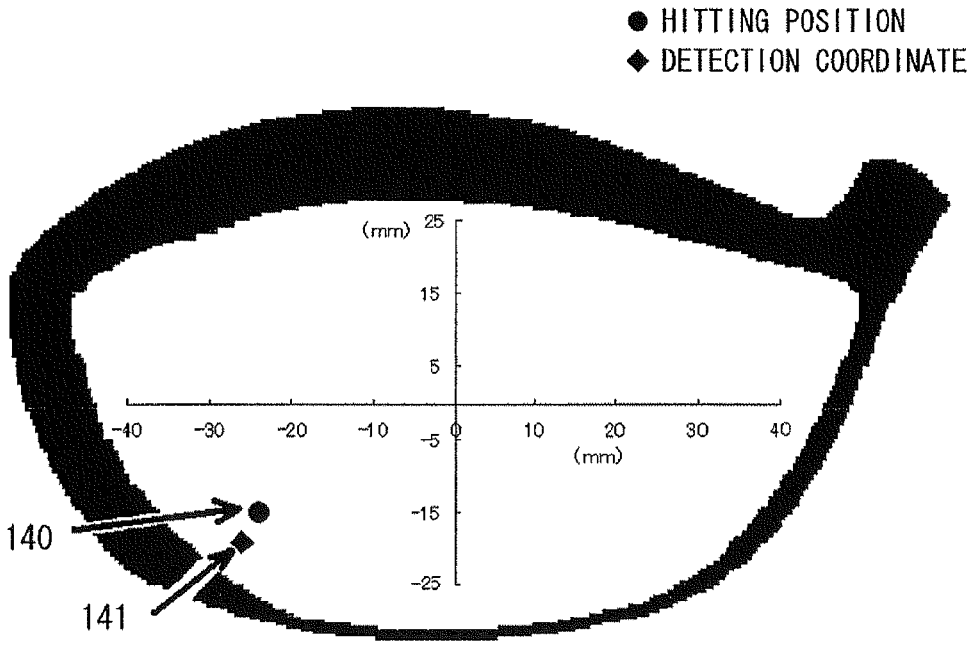
FIG. 12 is a diagram showing actual measurement values of a detected hitting position and of an actual hitting position.

FIG. 7 is a diagram showing actual measurement values of a difference in the arrival time of the leading wave of the pair of sensors and a difference in distance from the hitting position. That is, the difference in the arrival time of the leading wave of the pair of sensors is proportional to the difference in distance from the hitting position, and that is not dependent on the hitting speed (strength).

FIGS. 8, 9, 10, 11, and 12 are diagrams showing the comparison between the hitting position detected by the present invention and the hitting position measured from the hitting trace of the pressure sheet attached to the face portion. That is, the actual hitting position substantially coincides with the position detection results (reference numerals 132 and 133 in FIG. 8, reference numerals 134 and 135 in FIG. 9, reference numerals 136 and 137 in FIG. 10, reference numerals 138 and 139 in FIG. 11, and reference numerals 140 and 141 in FIG. 12), and the hitting position detecting means of the present invention is able to very accurately detect the hitting position substantially within an error range of 5 mm or less.

As the sensor for detecting the vibration wave, it is desirable to use a capacitive sensor in which the electric capacity is varied by the fluctuation of the vibration plate of the receiving unit upon receiving of the vibration wave. However, any sensor can be used which detects the instant waveform of the vibration wave. For example, a piezoelectric sensor for detecting the instant waveform by converting a pressure generated by the vibration wave into an electrical signal, or an optical sensor for detecting the vibration wave by detecting the instant vibration through optical means may be used. Those sensors are included in the scope of the present invention.

As a method of detecting the vibration wave, a method of detecting the mechanically propagated wave by fixing the sensor to the face portion is the best method having high detection accuracy and able to be easily contrived. A method of detecting the leading wave of the propagation of the sound wave or both of the mechanical propagation and the sound propagation may be used, and this method is included in the scope of the present invention.

It is ideal if the number of sensors detecting the vibration is four. Even in the case of three sensors, since two pairs of sensors can be formed, the position detection according to the method of the present invention can be performed, but there is an area where the detection accuracy is poor compared with the case of four sensors.

It is ideal if the installation position of the sensor for detecting the vibration is located in the vicinity of the outer periphery of the rear surface of the face portion and the vicinity of four corner points of a reverse trapezoid. Although it is dependent on the shape of the face portion, it is desirable that the lines, connecting the pairs of sensors disposed in the vicinity of four corner points and facing at the opposite angle, intersect each other in the vicinity of the center portion (in other words, the sweet spot) of the face portion.

The hitting position may be detected by the sensors (or the pairs of sensors) which are not provided in the vicinity of four corner points of the reverse trapezoid, where the lines connecting the pairs of sensors may not intersect each other in the vicinity of the center portion of the face portion, and the lines connecting the pair of sensors may not intersect each other. This is included in the scope of the present invention.

It is desirable that the sensor be fixed to the face portion via the elastic element. Since the elastic element needs to propagate the vibration wave and to protect the sensor from impact, it is the most desirable that the elastic element be made of natural rubber or materials having properties close thereto. In addition, the vibration wave may be detected in such a manner that the elastic body is perforated, and the sound wave is propagated in the extremely short distance from the face portion to the sensor. This is included in the scope of the present invention. In addition, an adhesive having elasticity in a cured state may be simultaneously used as a member fixing the sensor and as an interposed elastic body. This is included in the scope of the present invention.

In the calculation method of calculating a difference in distance from the detected difference in time, and detecting the hitting position from a difference in distance of two pairs of sensors, it is ideal to use a method of obtaining a difference in distance for each coordinate point of, for example, a lattice shape on the face portion, storing the result in the memory of the computer, and searching for the coordinate point (in other words, the coordinate point where the difference between both of them becomes the minimum) which is the closest to the detected difference in distance. The number of the coordinate points stored in advance for the difference in distance is limited in accordance with the size of the memory in use, but the accuracy can be improved by a degree corresponding to an increase in the size of the memory.

In addition, in the case where the memory needs to be decreased in size, for example, a method may be used which obtains a closeness degree between a point having a minimum difference between the stored distance difference and the detected distance difference and a point in the periphery thereof, and determines a middle point between the minimum point and the peripheral point to be the hitting position. This method is included in the scope of the present invention. In addition, a method of mathematically obtaining the hitting position may be used, and this method is included in the scope of the present invention.

<Embodiments>

Hereinafter, the present invention will be described in more detail with reference to the embodiments. However, the effectiveness of the present invention is not considered as being limited by the embodiments.

First Embodiment

The inventors first thought that the propagation of the sound wave could be used as a clue in the study of the detection of the hitting position of the face portion by using the sensors attached to the golf club. First, a method of detecting the position of the ball upon hitting of the ball on the basis of the reflection of an ultrasonic wave was considered, but it was difficult to detect the reflection of the sound wave colliding with the ball which is round in shape and collides with the face portion at a high speed.

Next, instead of the reflection of the sound wave, a method of searching for a sound source generated upon hitting of the ball was considered. However, an expert in searching for sound sources gave the advice that it is not possible to detect the propagation in the horizontal direction (excluding the vertical direction of the surface) of the surface on the grounds that a sound on a rigid metal plate such as titanium is instantly changed to a planar wave as in a planar speaker.

For this reason, the inventors abandoned this method once, but tried a test using the microphone sensor, just in case. As a result of the test, the arrival of the sound could not be reliably determined on the basis of the magnitude (amplitude) of the sound. However, amazingly, it was found that there was the relationship between the arrival time of the leading wave of the vibration wave and the distance from the hitting position to the sensor by referring to the instant waveform.

Therefore, the inventors started the testing in earnest. After the sensor is attached to a specific position of the face portion, the relationship between the hitting position and the arrival time of the leading wave of the vibration was investigated. A capacitive microphone sensor was used as the sensor, and an impact hammer GK-3100 manufactured by Ono Sokki Co., Ltd was used for the hitting action. Since the impact hammer included a sensor for detecting the strength of the instant hitting action, and the first start time point of the signal was set as the hitting time point (reference numeral 128 in FIG. 5).

The leading propagation of the signal received by the microphone sensor was indicated by reference numeral 129 in FIG. 5. The steep descending of the leading wave was determined by a predetermined reference voltage (threshold value) (reference numeral 130 in FIG. 5), and this time point was set as the arrival time (reference numeral 131 in FIG. 5). As a result, it was found that there was a substantially proportional relationship between the distance from the impact hammer to the microphone sensor and the period from the start time point of the signal of the impact hammer to the arrival time of the microphone sensor. In addition, at the same time, it was found that this relationship was exactly the same in all directions of the horizontal/vertical/inclined directions on the face portion when the hitting point is seen from the sensor (FIG. 6).

In addition, even in the case where the sound wave was detected while separating the sensor from the face portion, it was found that such a relationship was obtained. In addition, it was found that there were amazing differences in the sensor input magnitude and the receiving time in the case of detecting the mechanical vibration wave mainly propagated in the face portion and the case of detecting the sound wave while separating the sensor from the face portion.

By the previously performed testing, it was concluded that the hitting position could be specified by using a plurality of sensors when the distance from the hitting position to the sensor was detected on the basis of the response delay of the sensor after the hitting moment. However, as is understood from FIG. 6, the propagation of the vibration wave was about 2 μs per 1 mm, and in order to detect the propagation time of a distance of merely 80 mm from the face portion with an accuracy of about 1 mm, the hitting moment needed to be detected at a high speed within about 1 μs.

In order to realize this, for example, it was necessary to adopt a configuration in which a sensor with a high-speed response was provided inside the ball, and a signal was rapidly generated at the time of the hitting action by using certain means, or a configuration in which a high-speed sensor such as an optical sensor is installed on the outside of the golf club so as to generate a signal upon detecting of the hitting action. In the method of providing the sensor in the ball, since it is necessary to manufacture a special ball, there is a drawback in that a general ball cannot be used. In the method of detecting the hitting moment by installing the high-speed sensor on the outside of the golf club, there were inconveniences in that some equipment was required, and the equipment needed to be appropriately disposed to detect the hitting moment.

The inventors thought that the position could be detected by using a difference in the receiving time of the sensors without detecting the hitting moment. Therefore, after disposing two sensors at the appropriate positions on the face portion, the receiving signals of the vibration wave of two pairs of sensors were compared.

The magnitude of the receiving signal was not largely different in the sensors. The arrival time of the vibration wave for each sensor was compared at a certain level of voltage, and it was found that a difference $\Delta t = t2 - t1$ in time between the time (reference symbol t1 in FIG. 2) when the sensor A close to the hitting point P first receives the vibration wave and the time (reference symbol t2 in FIG. 2) until another sensor B receives the vibration wave from that receiving time was substantially proportional to a difference between a distance from the hitting point P to the sensor A and a distance from the hitting point P to the sensor B (FIG. 7).

Accordingly, new findings were obtained in which a difference in distance of the hitting position was calculated from the difference in the arrival time of two pairs of sensors, and a two-dimensional planar hitting position satisfying two conditions of the difference in distance could be specified when two pairs of sensors were provided, and the sensor positions were appropriately set.

An example of the test result is shown in FIG. 7. As is clear from FIG. 7, since there is a substantially proportional relationship between the difference Δt in the arrival time of the leading vibration wave of the pair of sensors and the difference ΔL in distance from the hitting point to the pair of sensors, the relationship expressed in the following equation was apparent.

$$\Delta L=\Delta t\times k+q$$

Here, k denotes a coefficient corresponding to the propagation speed of the vibration wave, and q denotes a constant obtained by the structure of the face portion or the sensor.

Here, in order to specify a two-dimensional planar position satisfying a difference between two detected distances, generally, a method was considered in which the numeral equation showing a difference in distance from the coordinates of the hitting position P and the coordinates of the sensor was mathematically obtained, the actually detected distance difference was applied to the equation, and the hitting position was obtained from two obtained equations.

Although the inventors examined the method, it was found that the calculation equation was complex, a great deal of time was taken for the calculation using the microcomputer mounted to the golf club, and large errors resulted from the calculation. Therefore, a method was contrived in which the distance differences ΔL1 and ΔL2 were obtained in advance from two pairs of sensors to each point of the face portion, the distance differences were stored in the memory of the microcomputer, and the point having the closest distance differences to the distance differences ΔLp1 and ΔLp2 obtained by the time difference detected by the actual hitting action was determined to be the hitting position.

The detection of "the point having the closest distance differences" could be simply detected in such a manner that the value of the following equation was obtained by repetitive calculation, and the coordinate P having the minimum value was searched for.

$$(\Delta L1-\Delta Lp1)^2+(\Delta L2-\Delta Lp2)^2$$

The golf club used in the actual test had the face portion of about 50 mm by 80 mm. One thousand points were formed on the surface by using a lattice shape having a pitch of 2 mm in the widthwise and lengthwise directions, and the distance difference ΔL1 and ΔL2 from each point to the pair of sensors were stored in the memory of the microcomputer.

For the arrangement position of the sensor, a great deal of experimental verification and study was performed. By experimenting, it was found that the determination of the hitting position was more influenced by errors of the detected distance difference in the case where the hitting position is extremely close to the sensor than in the case where the hitting position is far from the sensor. Generally, since the hitting position is mainly located at the center portion, particularly, the user has a desire to know the hitting position at the center portion with a high accuracy.

Accordingly, it was proved that the hitting position could be highly precisely detected over the entire surface and particularly in the vicinity of the center portion when the sensors were installed in the vicinity of the periphery of the face portion. In addition, it was found that the accuracy of the hitting position was improved and the possibility of breakage due to strong impact at the time of the hitting action was decreased when the sensors were installed in the peripheral portion and particularly in the vicinity of the four corners of a reverse trapezoid.

In addition, it was found that the detection accuracy of the hitting position at the center portion was high when the lines connecting two pairs of sensors intersect each other in the vicinity of the center portion of the face portion while substantially forming a right angle. Four sensors were disposed as described above. In the arrangement, in order to allow the sensor to withstand strong impact and to accurately fix the sensor to a predetermined position, a cylindrical metal piece having a diameter of 10 mm and a length of 2 mm was welded to a predetermined position, and a sensor adhered to a rubber piece was attached thereto.

An electronic circuit unit provided in a signal process unit performed the amplification of the sensor signal and a comparison with a predetermined arrival time determining voltage level (threshold value). Then, a separately provided timer unit stored the timer value at the arrival time point, and a time difference of a pair of sensors was obtained.

The relationship between the difference Δt in time and the difference ΔL in distance was obtained in advance by an experiment. The example is shown in FIG. 7, but in this case, by using the following transformation equation, $$\Delta L=0.46\Delta t+6.1$$

the difference in distance was calculated from the difference in time.

In the microcomputer for obtaining the time difference and calculating the hitting position from the result, a 16 bit one-chip microcomputer H8/3694 manufactured by Renesas Technology Corp. was used. A battery was used as a power source, and the power voltage of the microcomputer was set to 3.6 V by a boosting circuit. The operation transmitting frequency of the microcomputer was 10 MHz. In the manufactured detection device, the process time from the hitting detection to the hitting position determination was about 80 ms.

The trial hitting was actually performed by the manufactured golf club. FIGS. 8, 9, 10, 11, and 12 show an example of the test result.

The coordinates of the drawings correspond to an orthogonal coordinate system in which the center portion (sweet spot) of the face portion is set as an original point, the horizontal direction (a direction along the horizontal surface on the face portion when the club is close to the ground surface in a swing posture) is set as the X axis, and the vertical direction (a direction perpendicular to the ground surface) is set as the Y axis. As shown in the drawing, it was found that the hitting position could be detected with an accuracy of 5 mm or less throughout the entire face portion.

For the trial hitting, the tests were performed by a hammer, a swing of a robot, and a practical swing of a pro-golfer. In order to know the hitting point, a pressure sheet was attached to the face portion, and the center portion on the hitting trace of the ball marked on the sheet was determined to be the hitting position. The test was performed on the condition that the head speed was in a range of 20 m/s to 50 m/s. As a result, it was found that the hitting position could be specified within an error range of about 5 mm or less throughout the entire face portion by using the hitting position detecting method of the present invention.

Second Embodiment

In addition, as a result of observing an actual golf learner, it was found that the learner performed various actions other than the ball hitting action, such as swinging and missing (an action of just swinging the golf club without hitting the ball)

or clipping the ball with the club, as well as an action of just swinging the golf club to hit the ball. Therefore, it was considered that the hitting time point needed to be detected only when the swing action was performed to hit the ball.

The inventors attached a three-axis acceleration sensor to the golf club to detect the head speed by using the acceleration sensor, and created a computer program for determining the earnest hitting swing when the head speed exceeded 10 m/s. By using the computer program, the propagation wave arrival detecting circuit and the microcomputer were automatically set to the hitting position detection mode, and only the hitting position detection result was displayed after the hitting action.

In addition, as for the display of the hitting position, an image of the face portion was displayed on a reflection-type dot matrix LCD display unit and a black circle ● was marked at the position determined to be the hitting position. The outer dimension of the display unit was 46 mm in the lengthwise direction and 22 mm in the widthwise direction, and the display unit was fixed (to the side of the club of the grip) below the grip of the shaft. The diameter of the grip in the vicinity thereof is about 20 mm, and is made to have substantially the same size as that of the shaft. As a result, the display unit did not cause any inconvenience, and the possibility of causing the breakage of the golf club was low due to the shape thereof.

Furthermore, a score display was provided so that the score was high when the detected hitting position was in the vicinity of the sweet spot causing a great driving distance and the score was low as the detected hitting position was closer to the periphery of the face portion. The score was set to the range of 0 to 100. With such a configuration, the learner could easily understand their technical improvement degree as the "score" during the practice of accurately hitting the ball against the center portion of the face portion.

Furthermore, the user gave an evaluation such that a desire for improvement could be developed due to the awareness of a variation in score. In addition, the driving distance of the ball estimated on the basis of the hitting position and the head speed was displayed together with the head speed detected by the acceleration sensor. The value of the relationship of the hitting position, the head speed, and the driving distance could be exhibited for the first time since the hitting position could be accurately detected by the present invention.

Even if there was a claim that the display of the driving distance would be effective in an industrial field on the basis of the assumption that "if the hitting position could be detected . . . ", this claim was previously merely wishful thinking. However, since the hitting position can be accurately detected by the present invention, the display of the driving distance based on the accurate detection can be successfully given as useful information to a user for the first time.

Third Embodiment

In the first embodiment, the inventors used a capacitive sensor called a condenser microphone having a property suitable for the object of the present invention. This sensor is capable of accurately detecting the leading propagation wave, but another sensor may be used if the sensor has the same performance. As a desirable example, a microphone was used, but if another pair of sensors was capable of detecting the time difference with high sensitivity, those sensors may be used. As the sensor, not all sensors may be used, but a person skilled in the art may select a proper one which has high sensitivity. For example, a piezoelectric sensor having a rapid response may be used, and this is included in the scope of the present invention. In addition, although there is provided an elastic body mainly containing natural rubber between the face portion and the sensor for detecting the vibration wave, if the sensor itself has a structure for withstanding impact, the same result can be obtained without essentially providing the additional elastic body, and this is included in the scope of the present invention.

Also, even in the case where an adhesive for fixing the sensor is formed of a material exhibiting the effect of the elastic body, the same advantage can be obtained, and this is included in the scope of the present invention. In addition, the hitting impact may be reduced by coating the surface of the face portion with a certain surface treatment material, and this is also included in the scope of the present invention.

In addition, in the embodiment, a method of comparing the waveform of the leading vibration wave with a predetermined voltage (threshold value) and, a method was used in which the arrival time was detected based on the exceeding of the value. However, the method may be modified so as to detect the time point at which the waveform of the vibration wave is first steeply changed as the arrival time. For example, the time point at which the output obtained by differentiating the signal of the sensor becomes large (i.e., a predetermined value or more) may be set as the arrival time of the leading vibration wave, and this is included in the scope of the present invention.

In the first embodiment, the two-dimensional coordinate position was obtained from a difference in the arrival time between two pairs of sensors. However, three pairs of sensors may be provided, and a three-dimensional coordinate position may be obtained from a difference in arrival times. The concept thereof is the same as the concept of the present invention, and this is also included in the scope of the present invention.

In addition, in the embodiment, the means for storing a difference in distance between two pairs of sensors and searching for the point having a detection result close thereto was used. However, of course, means for obtaining the hitting position by calculating a solution of a numeral equation may be used, and means for obtaining the solution by approximating the numeral equation as a simple numeral equation may be used. This is included in the scope of the present invention.

Furthermore, in the search for the point having a close detection result, means for obtaining a closeness degree between the point having the closest detected distance difference and the peripheral point thereof by calculation, and determining the middle point between the closest point and the peripheral point to be the hitting position in accordance with the closeness degree may be used, and this is included in the scope of the present invention.

Alternatively, instead of storing the distance difference, modification may be made so as to store the time difference result (or the result obtained by converting the distance difference into the time difference) measured for each point, and search for the point where the detected time difference coincides with the stored time difference, and this is included in the scope of the present invention.

Furthermore, in the embodiment, as the points which are used for the distance difference from two pair of sensors and are stored in advance, the points of the lattice shape having a pitch of 2 mm in the horizontal and vertical directions of the face portion were selected, and the time difference for each point was stored in the microcomputer, thereby detecting the coordinate position. When the storage capacity is increased, of course, the very tiny lattice points having a pitch smaller than 2 mm can be stored. As the pitch becomes smaller, the search accuracy (detection accuracy) can be improved.

Furthermore, the stored points with uniform density in the entire face portion may not be essentially selected. For example, modification may be made so as to improve the accuracy at the center portion by selecting many stored points in the vicinity of the center portion. In addition, the stored coordinate points may not be the points in the orthogonal coordinate system having the horizontal and vertical directions, but may be the concentric points in the polar coordinate system in which the center portion of the face portion is set as the original point. The method of selecting the preliminarily stored points is included in the scope of the present invention.

Fourth Embodiment

Figure 14:
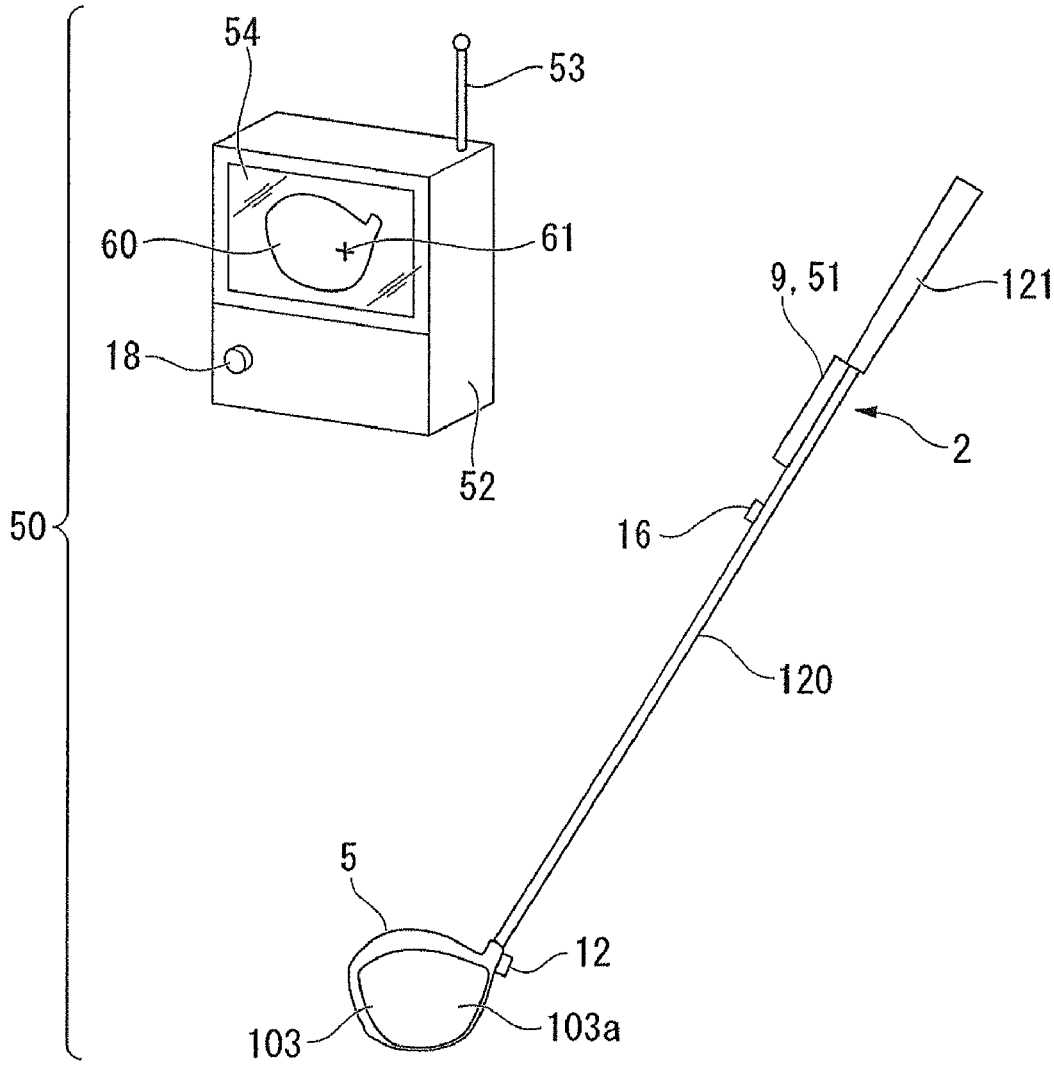
FIG. 14 is a schematic diagram showing another embodiment of a hitting position detecting device according to the present invention.

FIG. 14 shows another embodiment of the present invention. A hitting position detecting device 50 of the embodiment is different from the above-described hitting position detecting device 1 in that there are further provided a transmitting unit 51 for wirelessly transmitting the electrical signals output from the microphone sensors 104, 105, 106, and 107, and a receiving unit 52 provided separately from the golf club 2 and receiving the electrical signals. The receiving unit 52 receives the signals transmitted from the transmitting unit 51 via an antenna 53. In this case, a display unit 54 for displaying the hitting position is integrated with the receiving unit 52. In addition, the receiving unit 52 includes a reset button 18. The calculation unit 9 may be installed in the receiving unit 52 or the transmitting unit 51. FIG. 14 shows a head portion schematic image 60 and a hitting position display symbol 61 ("+" in the example shown in the drawing) which is displayed while being overlapped therewith.

Fifth Embodiment

Figure 15:
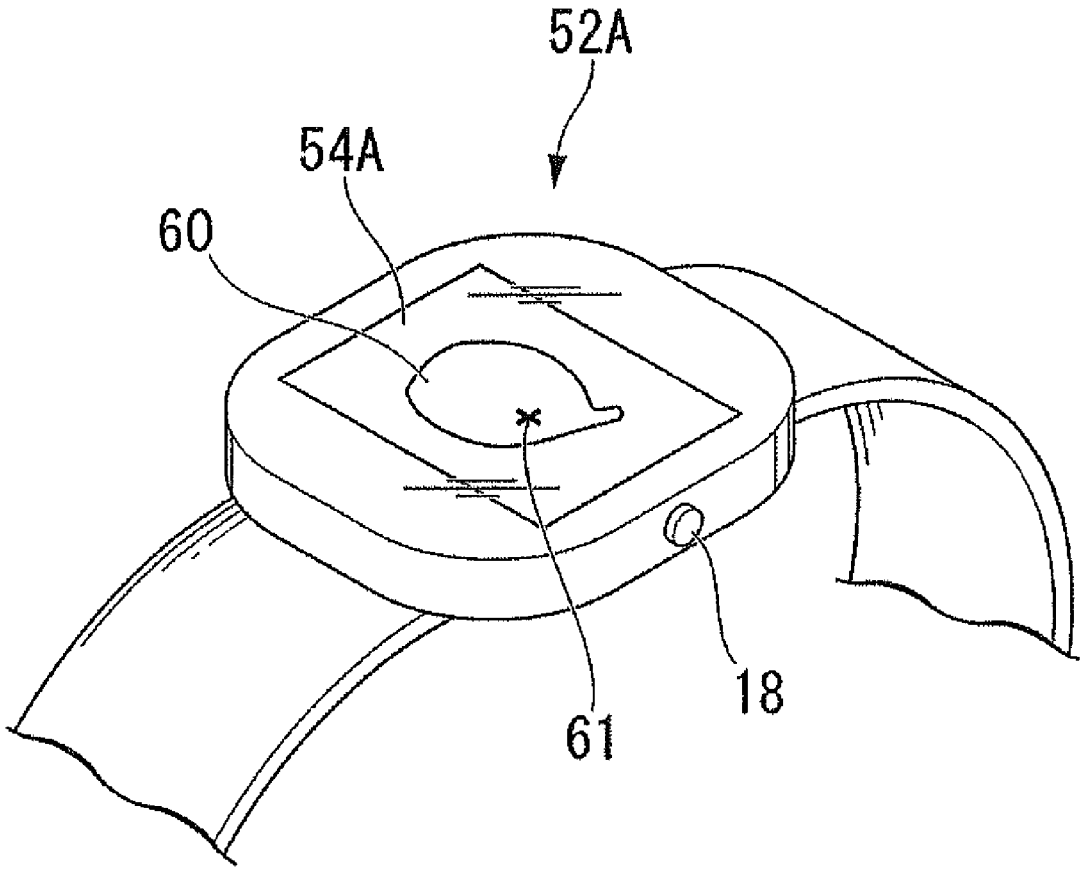
FIG. 15 is a schematic diagram showing still another embodiment of a hitting position detecting device according to the present invention.

FIG. 15 shows an embodiment in which the receiving unit 52 is formed as a wristwatch-type receiving unit 52A. In this case, a display unit 54A is comparatively small, but can be easily viewed because the display unit is always on hand. The wristwatch-type receiving unit 52A or the reset button 18 is provided. FIG. 15 shows the head portion schematic image 60 and the hitting position display symbol 61 ("+" in the example shown in the drawing) which is displayed while being overlapped therewith.

In addition, in the above-described embodiments, the microphone sensors (vibration wave sensors) are provided in the vicinity of four corner points of a trapezoid in the face portion. However, when the center portion of the face portion is set as an original point, the horizontal direction is set as the X axis, and the vertical direction is set as the Y axis, four sensors including two sensors disposed at the positions (−A, 0) and (+A, 0) as a pair, and two sensors disposed at the positions (0, +B) and (0, −B) as another pair are provided, the former pair may independently detect the horizontal position, and the latter pair may independently detect the vertical position.

Furthermore, in the above-described embodiments, a method is used which compares the value of the distance difference ΔL obtained by the signal of the vibration wave sensor with the existing ΔL, and outputs the closest point as the hitting position. However, the hitting position may be directly estimated by mathematical calculation without using the existing ΔL.

INDUSTRIAL APPLICABILITY

The present invention is particularly helpful in industries manufacturing golf clubs and sports equipments. Furthermore, the present invention may be used as a calibration device for equipment.

The invention claimed is:

1. A hitting position detecting device comprising:

a golf club which includes a shaft having a grip portion and a head portion having a face portion with a hitting surface and a rear surface and attached to the front end of the shaft;

at least three vibration wave sensors which are arranged on the side of the rear surface of the face portion and fixed to the head portion so as to output electrical signals in accordance with a vibration wave generated upon hitting of the face portion;

a calculation unit which detects arrival times in the vibration wave sensors of the vibration wave generated in the face portion upon hitting of a ball on the basis of the electrical signals, calculates a hitting position of the ball in the face portion on the basis of a difference in the plurality of arrival times, and then outputs the result as a hitting position signal;

a display unit which displays the hitting position in the face portion on the basis of the hitting position signal output from the calculation unit; and a power source which supplies power to the vibration wave sensors, the calculation unit, and the display unit;

wherein the calculation unit detects a difference in arrival by setting two vibration, wave sensors as a pair, and calculates the hitting position on the basis of the difference in arrival time obtained by at least two pairs of vibration wave sensors.

2. The hitting position detecting device according to claim 1, wherein the calculation unit calculates $\Delta L1 = a \times \Delta T1 + b$ on the assumption that (1) each difference when a first pair of the vibration wave sensors detects arrival of the vibration wave is denoted by $\Delta T1$, (2) each difference when a second pair of the vibration wave sensors detects arrival of the vibration wave is denoted by $\Delta T2$, (3) vibration propagation constants stored in advance in the calculation unit are denoted by a, b, c, and d, and (4) a difference in distance from each of the first pair of vibration wave sensors to an imaginary hitting position is denoted by $\Delta L1$, wherein the calculation unit calculates $\Delta L2 = c \times \Delta T2 + d$ on the assumption that (5) a difference in distance from each of the second pair of vibration wave sensors to the imaginary hitting position is denoted by $\Delta L2$, wherein the calculation unit assumes that (6) a difference in distance obtained in advance from each of the first pair of vibration wave sensors to each position P in all areas having desired hitting positions on the face portion is denoted by $\Delta Lp1$, and (7) a difference in distance obtained in advance from each of the second pair of vibration wave sensors to each position P in all areas having desired hitting positions on the face portion is denoted by $\Delta Lp2$, wherein (8) the calculation unit obtains a position Ps by the following equation of $$Ps = \min\{(\Delta Lp1 - \Delta L1)^2 + (\Delta Lp2 - \Delta L2)^2\}$$

on the assumption that an operator min{ } denotes a position P where the value { } becomes minimum, and wherein the calculation unit determines the position Ps to be the hitting position.

3. The hitting position detecting device according to claim 1, wherein the hitting surface of the face portion is substantially formed in a trapezoid, and wherein four vibration wave sensors are respectively disposed at four corner points of the trapezoid.

4. The hitting position detecting device according to claim 3, wherein diagonal lines of the trapezoid intersect each other at the center portion of the face portion.

5. The hitting position detecting device according to claim 3, comprising an operation error detection unit which detects an operation error of one of the four vibration wave sensors, wherein when the operation error detection unit detects an operation error of one of the vibration wave sensors, the calculation unit sets the other three vibration wave sensors as two pairs, and calculates the hitting position.

6. The hitting position detecting device according to claim 1, wherein the vibration wave sensors are fixed to the rear surface of the face portion via at least one of a viscoelastic element and an elastic element.

7. The hitting position detecting device according to claim 1, wherein the vibration wave sensors are fixed to the face portion so as to be perpendicular thereto, and are fixed by cylindrical elements each having a cavity therein.

8. The hitting position detecting device according to claim 1, comprising a measurement unit which measures at least one physical characteristic selected from a group including a position, an angle, a speed, and an acceleration of the shaft, and a speed and an acceleration of the head portion, wherein the calculation unit is activated when at least one of the physical characteristics measured by the measurement unit reaches a predetermined value.

9. The hitting position detecting device according to claim 1, comprising a head speed measurement unit which detects a speed of the head portion, wherein the calculation unit calculates a driving distance of a golf ball hit based on the head speed and the hitting position, and the display unit displays the driving distance thereon.

10. The hitting position detecting device according to claim 1, wherein the display unit displays the hitting position by using a predetermined symbol on a schematic figure of the head portion.

11. The hitting position detecting device according to claim 1, wherein the calculation unit calculates a higher score for the hitting position located closer to a great driving distance area or a sweet spot of the face portion, and wherein the display unit displays the score thereon.

12. The hitting position detecting device according to claim 10, wherein the display unit has a function of blinking the symbol.

13. The hitting position detecting device according to claim 1, wherein the calculation unit has a memory function of storing of the hitting position signal, and displays the past hitting position on the display unit in accordance with a request.

14. The hitting position detecting device according to claim 1, wherein the vibration wave sensors automatically enter a measurement mode at the time of a swing action, and wherein the display unit automatically changes a display screen at the time of the swing action, and includes a reset button for returning an erased image to an original state.

15. The hitting position detecting device according to claim 1, wherein at least a part of the shaft and the head portion are covered by an electric power generating element, and wherein the electric power generating element is electrically connected to the vibration wave sensors and the display unit so as to supply at least a part of required electric power thereto.

16. The hitting position detecting device according to claim 1, further comprising:

a transmitting unit which wirelessly transmits the electrical signals output from the vibration wave sensors; and a receiving unit which is provided separately from the golf club and receives the electrical signals, wherein the calculation unit and the display unit are disposed separately from the golf club, and are connected to the receiving unit.

17. A hitting position detecting method comprising:

hitting a ball by using a golf club which includes a shaft having a grip portion and a head portion having a face portion with a hitting surface and a rear surface and attached to the front end of the shaft;

detecting each time at which a vibration wave generated in the face portion upon hitting of the ball arrives at vibration wave sensors which are arranged on the side of the rear surface of the face portion and is fixed to the head portion;

calculating a hitting position of the ball in the face portion on the basis of each difference in arrival time of the vibration wave and outputting the result as a hitting position signal; and displaying the hitting position in the face portion on the basis of the hitting position signal;

wherein the number of the vibration wave sensors is at least three, and the detection of the difference in arrival time is performed by at least two pairs of vibration wave sensors by setting two vibration wave sensors as a pair, and wherein the calculation of the hitting position is performed by the following steps:

calculating $\Delta L1 = a \times \Delta T1 + b$ on the assumption that (1) each difference when a first pair of the vibration wave sensors detects arrival of the vibration wave is denoted by $\Delta T1$, (2) each difference when a second pair of the vibration wave sensors detects arrival of the vibration wave is denoted by $\Delta T2$, (3) vibration propagation constants stored in advance in the calculation unit are denoted by a, b, c, and d, and (4) a difference in distance from each of the first pair of vibration wave sensors to an imaginary hitting position is denoted by $\Delta L1$;

calculating $\Delta L2 = c \times \Delta T2 + d$ on the assumption that (5) a difference in distance from each of the second pair of vibration wave sensors to the imaginary hitting position is denoted by $\Delta L2$;

assuming that (6) a difference in distance obtained in advance from each of the first pair of vibration wave sensors to each position P in all areas having desired hitting positions on the face portion is denoted by $\Delta Lp1$, and (7) a difference in distance obtained in advance from each of the second pair of vibration wave sensors to each position P in all areas having desired hitting positions on the face portion is denoted by ΔLp2, wherein (8) the calculation unit obtains a position Ps by the following equation of $$Ps=\min\{(\Delta Lp1-\Delta L1)^2+(\Delta Lp2-\Delta L2)^2\}$$

on the assumption that an operator min{ } denotes a position P where the value { } becomes minimum; and determining the position Ps to be the hitting position.

18. A method of manufacturing a hitting position detecting device, comprising:

installing three or more sensors in a rear surface as a back potion of a face portion in the vicinity of the contoured portion or the substantially outermost periphery of a hitting surface called the face portion of a golf club so as to detect a vibration wave generated upon hitting of a golf ball;

installing a calculation processing unit which calculates minute differences in arrival times of the vibration wave generated upon hitting of the ball by using two pairs of sensors in which arbitrary two sensors are set as a pair, and a combination of one of the two sensors and another sensor or a combination of two sensors other than the two sensors is set as another pair;

installing a calculation function microcomputer unit which substantially calculates the hitting position on the basis of the minute difference in times obtained by each of the pairs of sensors;

installing a display unit in a shaft of the golf club so as to simultaneously display a hitting position and an approximate outer shape of the face portion; and installing a power supply for the microcomputer.

* * * * *